US010253972B2

(12) United States Patent
Wells et al.

(10) Patent No.: US 10,253,972 B2
(45) Date of Patent: Apr. 9, 2019

(54) TRANSITION CASTING FOR BOILER WITH STEAM COOLED UPPER FURNACE

(71) Applicant: The Babcock & Wilcox Company, Barberton, OH (US)

(72) Inventors: Eric L Wells, Massillon, OH (US); Roger A Detzel, Uniontown, OH (US); Albert J Bennett, Doylestown, OH (US); Steven D Thayer, Minerva, OH (US); Kevin L Brewster, North Canton, OH (US)

(73) Assignee: The Babcock & Wilcox Company, Barberton, OH (US)

( * ) Notice: Subject to any disclaimer, the term of this patent is extended or adjusted under 35 U.S.C. 154(b) by 0 days.

(21) Appl. No.: 15/099,192

(22) Filed: Apr. 14, 2016

(65) Prior Publication Data

US 2017/0299172 A1 Oct. 19, 2017

(51) Int. Cl.

| | |
|---|---|
| ***F22B 37/10*** | (2006.01) |
| ***F22B 37/12*** | (2006.01) |
| ***F22B 21/34*** | (2006.01) |
| ***F22B 33/16*** | (2006.01) |
| ***F22B 29/06*** | (2006.01) |

(Continued)

(52) U.S. Cl.

CPC ..... *F22B 37/104* (2013.01); *F22B 21/341* (2013.01); *F22B 29/062* (2013.01); *F22B 33/16* (2013.01); *F22B 37/101* (2013.01); *F22B 37/12* (2013.01); *F22G 1/005* (2013.01); *F22G 3/009* (2013.01)

(58) Field of Classification Search

CPC ... F24H 1/30; F24H 1/406; F22G 7/14; F22G 3/009; F22G 1/005; F22B 21/32; F22B 21/34; F22B 21/341; F22B 21/343; F22B 21/345; F22B 21/36; F22B 21/363; F22B 21/36638; F22B 21/40; F22B 33/16; F22B 37/12; F22B 37/104; F22B 29/062; F22B 37/101

See application file for complete search history.

(56) References Cited

U.S. PATENT DOCUMENTS 3,007,456 A * 11/1961 Murray ..... F22B 21/341 122/33
4,418,652 A * 12/1983 Rees ..... F22B 37/125 122/235.12

(Continued)

FOREIGN PATENT DOCUMENTS

GB 531132 A * 12/1940 ..... F24H 1/406

*Primary Examiner* — Steven B McAllister
*Assistant Examiner* — Steven S Anderson, II
(74) *Attorney, Agent, or Firm* — Michael J. Seymour

(57) ABSTRACT

Transition castings are disclosed which comprise a steam tube and a water tube, which are joined together by membranes. A heat transfer fin extends from the membrane and abuts the water tube. The steam tube bends such that an upper end is on one side of the water tube, and a lower end is on an opposite side of the water tube. The transition castings are used in a transition section of a boiler in which the furnace is divided into a lower furnace and an upper furnace. The lower furnace uses water-cooled membrane walls, while the upper furnace uses steam-cooled membrane walls that act as superheating surfaces. The transition casting joins the lower furnace and the upper furnace together.

15 Claims, 19 Drawing Sheets

(perspective view of 1st embodiment of Argt. #1)

(51) Int. Cl.
*F22G 3/00* (2006.01)
*F22G 1/00* (2006.01)

(56) References Cited

U.S. PATENT DOCUMENTS

| | | | | |
|---|---|---|---|---|
| 4,512,336 | A * | 4/1985 | Wiener | F22B 1/006 126/651 |
| 5,755,187 | A * | 5/1998 | Nordenberg | F22B 31/045 122/245 |
| 2010/0139535 | A1* | 6/2010 | Gunther | F22B 37/108 110/322 |
| 2010/0199978 | A1* | 8/2010 | Plotkin | F24J 2/07 126/704 |

* cited by examiner (perspective view of 1st embodiment of Argt. #1)

(front view of 1st embodiment of Argt. #1)

(side view of 1st embodiment of Argt. #1)

(perspective view of 2nd embodiment of Argt. #1)

(front view of 2nd embodiment of Argt. #1)

(perspective view of 3rd embodiment of Argt. #1)

(front view of 3rd embodiment of Argt. #1)

(side view of 3rd embodiment of Argt. #1)

(perspective view of Argt. #2)

(side view of Argt. #2)

(top view of Argt. #2)

(cross-sectional front view of Argt. #2 along A-A)

(cross-secitonal view of Argt. #2 along B-B)

TRANSITION CASTING FOR BOILER WITH STEAM COOLED UPPER FURNACE

BACKGROUND

The present disclosure relates generally to the field of power generation and boiler design. More particularly, the present disclosure is directed to a transition casting for providing a transition between steam-cooled tubes and water-cooled tubes of a boiler. The transition casting can be used, for example, to provide a transition between a water-cooled lower furnace and a steam-cooled upper furnace and act as a pressure seal therebetween.

Small coal-fired boilers find application in diverse settings, such as where power requirements are relatively low (e.g. rural areas, underdeveloped regions), where coal is readily available, and so forth. Typical small coal-fired boilers for electric power generation employ a sub-critical natural circulation design. An example of such a boiler design is the Babcock & Wilcox Carolina-Type Radiant Boiler design. This design employs a furnace with membraned water-cooled furnace walls that feed one or more steam drums. Water passing through the furnace walls absorbs heat energy, in effect cooling the tubes/pipes directly exposed to the combustion heat. The steam drum(s) feeds one or more primary superheaters located inside a convection pass, and one or more secondary pendant superheaters located inside the upper portion of the furnace. This superheated steam is used to run a high-pressure turbine. The steam exiting the high-pressure turbine is then sent through reheaters to increase the temperature again, so that the steam can then be used to run a low-pressure turbine.

Water-cooled pipes or tubes are designed to carry wet steam (i.e. a steam/water mixture, or equivalently, steam quality less than 100%). For a given operating pressure, the temperature of wet steam is thermodynamically limited to the boiling temperature of liquid water at the given operating pressure. In practice, water-cooled pipes are designed for an operating temperature of about 650° F.-670° F., corresponding to an operating pressure of about 2200-2600 psig. In a sub-critical boiler, water-cooled pipes feed wet steam into the steam drum.

By contrast, steam-cooled pipes or tubes are designed to carry superheated steam having a steam quality of 100% (i.e., no liquid component). The temperature of superheated steam is not thermodynamically limited for a given pressure, and in Carolina-Type designs the steam-cooled superheaters generally carry superheated steam at temperatures of about 1000° F.-1050° F.

Because of the differences in temperature, water-cooled pipes can be made of lower cost carbon steel, whereas steam-cooled pipes are made of more costly steel compositions. A design such as the Carolina-Type Radiant Boiler advantageously leverages these factors by designing the entire furnace to be water-cooled, so that the membraned walls can use lower cost carbon steel pipes and connecting membranes. The higher alloy superheater components are located within the furnace and convection pass (i.e inside the walls of the boiler), and are not membraned. In such designs, the membraned water-cooled walls are generally cooler than the flue gas to which the steam-cooled superheaters are exposed, due to more efficient heat transfer to the steam/water mixture carried by the water-cooled pipes.

In certain applications, it is desirable to obtain steam at high temperatures after superheating and after reheating, e.g. about 1050° F. after both cycles. This can be difficult in small designs, and further designs and methods are needed to obtain such high temperatures.

BRIEF DESCRIPTION

The present disclosure relates, in various embodiments, to a transition casting for providing a transition between steam-cooled tubes and water-cooled tubes of a boiler. The transition casting includes steam tubes and water tubes.

Use of a transition casting allows for a mechanically sound design in which the transition casting can serve as a pressure seal between the tubes of the upper and lower furnaces. Further, use of a transition casting provides for a tighter tube configuration by allowing for the bends in the tubes to be made at a much smaller radius in comparison to traditional bent tube transitions (i.e., transitions not employing a casting). This smaller radius for the bend in the tubes allows for a narrow membrane area to need to be provided between the tubes to achieve the pressure seal, which likewise produces lower membrane temperatures and a longer life.

The transition casting is designed to act as a pressure seal and to distribute heat across both the steam-cooled and water-cooled tubes to keep the average tube temperature below the use limit of the transition casting. Such a casting allow for the design of small, high-temperature, subcritical, coal-fired radiant boilers at 2800 psig and 1050° F. superheat and 600 psig and 1050° F. reheat. The transition casting allows for the design of such a radiant boiler of 150 MW and 350 MW sizes, in comparison to traditional boilers requiring sizes of up to 1300 MW.

In traditional boilers with a separate furnace, all of the weight of the furnace is transmitted through the tubes to top steel. These traditional boilers often require the use of water-cooled support tubes that transmit the weight to top steel. Use of such support tubes further requires additional refractory seals between the steam-cooled surfaces and the support tubes to make the boiler fluid-tight. The use of a transition casting will allow 100% of the weight of both the upper and lower furnaces to be transmitted to top steel, while still maintaining a pressure seal.

It would be desirable to provide a transition casting that would allow for the design of competitive boilers in the small, high-temperature, subcritical, coal-fired market, that has reduced costs and design/manufacturing time. It would further be desirable to provide a RBT having a steam-cooled upper furnace and water-cooled lower furnace with a transition casting provided therebetween to meet desired higher temperature/pressure applications.

In some illustrative embodiments disclosed herein, a transition casting has a first steam tube, a first water tube, a membrane joining the first steam tube and the first water tube to form a pressure seal therebetween, and a first heat transfer fin extending from the membrane and abutting the first water tube. The first steam tube has a steam tube diameter and a steam passageway extending between a front end pointing in a forward direction and a vertical end pointing in a first vertical direction. The first water tube has a water tube diameter and a water passageway extending between a first end and a vertical end pointing in a second vertical direction opposite the first vertical direction. The water passageway has at least one bend between the first end and the vertical end of the first water tube. The front end of the first steam tube may be in vertically aligned arrangement with the first end of the first water tube. In certain embodiments, the heat transfer fin is welded to both the first steam tube and the first water tube and extends therebetween.

In certain illustrative embodiments disclosed herein, the first end of the first water tube is a front end pointing in the forward direction. In some embodiments, the water passageway has at least two bends between the first end and the vertical end thereof. The at least two bends can include a first bend and a second bend. The first bend may have an angle of about 90° relative to a horizontal axis defined by the forward direction, and the second bend may have an angle of about 45° relative to the horizontal axis defined by the forward direction.

In particular illustrative embodiments, the transition casting includes additional steam tubes, water tubes, and/or heat transfer fins. More particularly, the transition casting can include a second steam tube having the steam tube diameter and a steam passageway extending between a front end pointing in a forward direction and a vertical end pointing in a first vertical direction. The vertical ends of the first steam tube and the second steam tube can be offset in the same lateral direction relative to the vertical end of the first water tube. The front ends of the first steam tube and the second steam tube may also be both vertically and laterally offset from the first end of the first water tube. Furthermore, the front end of the first steam tube may be in vertically aligned arrangement with the first end of the first water tube and the front end of the second steam tube may be vertically offset from the first end of the first water tube.

The transition casting may also include a second heat transfer fin welded to and extending from the membrane and abutting the first water tube. When additional steam tubes, water tubes, and/or heat transfer fins are provided, the membrane joins all of the tubes together to form a pressure seal therebetween.

In some illustrative embodiments disclosed herein, a transition casting has a first steam tube, a first water tube, and a membrane joining the first steam tube and the first water tube to form a pressure seal therebetween. The first water tube has a water tube diameter and a water passageway extending between a front end pointing in a forward direction and a vertical end pointing in the second vertical direction. The first steam tube has a steam tube diameter and a steam passageway extending between an upper end pointing in a first vertical direction and a lower end pointing in a second vertical direction opposite the first vertical direction. The steam passageway of the first steam tube includes a first vertical section extending between the upper end and an intermediate section, the intermediate section extending between the first vertical section and a second vertical section, and the second vertical section extending to the lower end. The intermediate section of the first steam tube bends such that the upper end of the first steam tube is on one side of a first lateral side of the first water tube, and the lower end of the first steam tube is on an opposite side of the first lateral side.

In certain embodiments, the first vertical section of the first steam tube may extend substantially parallel to the second vertical section of the first steam tube. The intermediate section of the first steam tube may extend horizontally between the first and second vertical sections. The intermediate section can terminate at bends separating the intermediate section from the first and second vertical sections. The front and vertical ends of the first water tube may be in laterally aligned arrangement with one another.

In particular embodiments, the first water tube includes an intermediate section extending offset from an axis passing through the centers of the front and vertical ends of the first water tube. The intermediate section of the first steam tube may extend across the intermediate section of the first water tube, such that the second vertical section of the first steam tube extends adjacent to the intermediate section of the first water tube in a lower vertical direction. A first heat transfer fin can extend from the membrane and abut the first water tube.

In particular illustrative embodiments, the transition casting includes additional steam tubes, water tubes, and/or heat transfer fins. More particularly, the transition casting can include a second steam tube having the steam tube diameter and a steam passageway extending between an upper end pointing in a first vertical direction and a lower end pointing in a second vertical direction opposite the first vertical direction. The steam passageway of the second steam tube includes a first vertical section extending between the upper end and an intermediate section, the intermediate section extending between the first vertical section and a second vertical section, and the second vertical section extending to the lower end. The intermediate section of the second steam tube bends such that the upper end of the second steam tube is on one side of the first lateral side of the first water tube, and the lower end of the second steam tube is on an opposite side of the first lateral side. The second steam tube may extend across the intermediate section of the first water tube, such that the second vertical section of the second steam tube extends adjacent to the intermediate section of the first water tube in the lower vertical direction.

When first and second steam tubes are provided, the first vertical sections of the first and second steam tubes may extend substantially parallel to one another in the upper vertical direction and the second vertical sections of the first and second steam tubes may extend substantially parallel to one another in the lower vertical direction. A second heat transfer fin may be provided that extends from the membrane and abuts the first water tube. The second heat transfer fin may be welded to both the second steam tube and first water tube and extend therebetween.

The water tube diameter may be greater than the steam tube diameter, and the transition casting may be made of stainless steel.

In some illustrative embodiments disclosed herein, a boiler has an upper furnace, a lower furnace, and a transition casting as disclosed in one of the embodiments herein. The upper furnace has steam-cooled membrane walls comprising steam wall tubes. The lower furnace has water-cooled membrane walls comprising water wall tubes. In particular embodiments of the boiler disclosed herein, the first steam tube is fluidly connected to a steam inlet header, and the first water tube is fluidly connected to a water outlet header located below the transition casting. In additional embodiments of the boiler disclosed herein, the lower furnace is top-supported through the transition casting.

These and other non-limiting aspects and/or objects of the disclosure are more particularly described below.

BRIEF DESCRIPTION OF THE DRAWINGS

The following is a brief description of the drawings, which are presented for the purposes of illustrating embodiments disclosed herein and not for the purposes of limiting the same.

DETAILED DESCRIPTION

Figure 1:
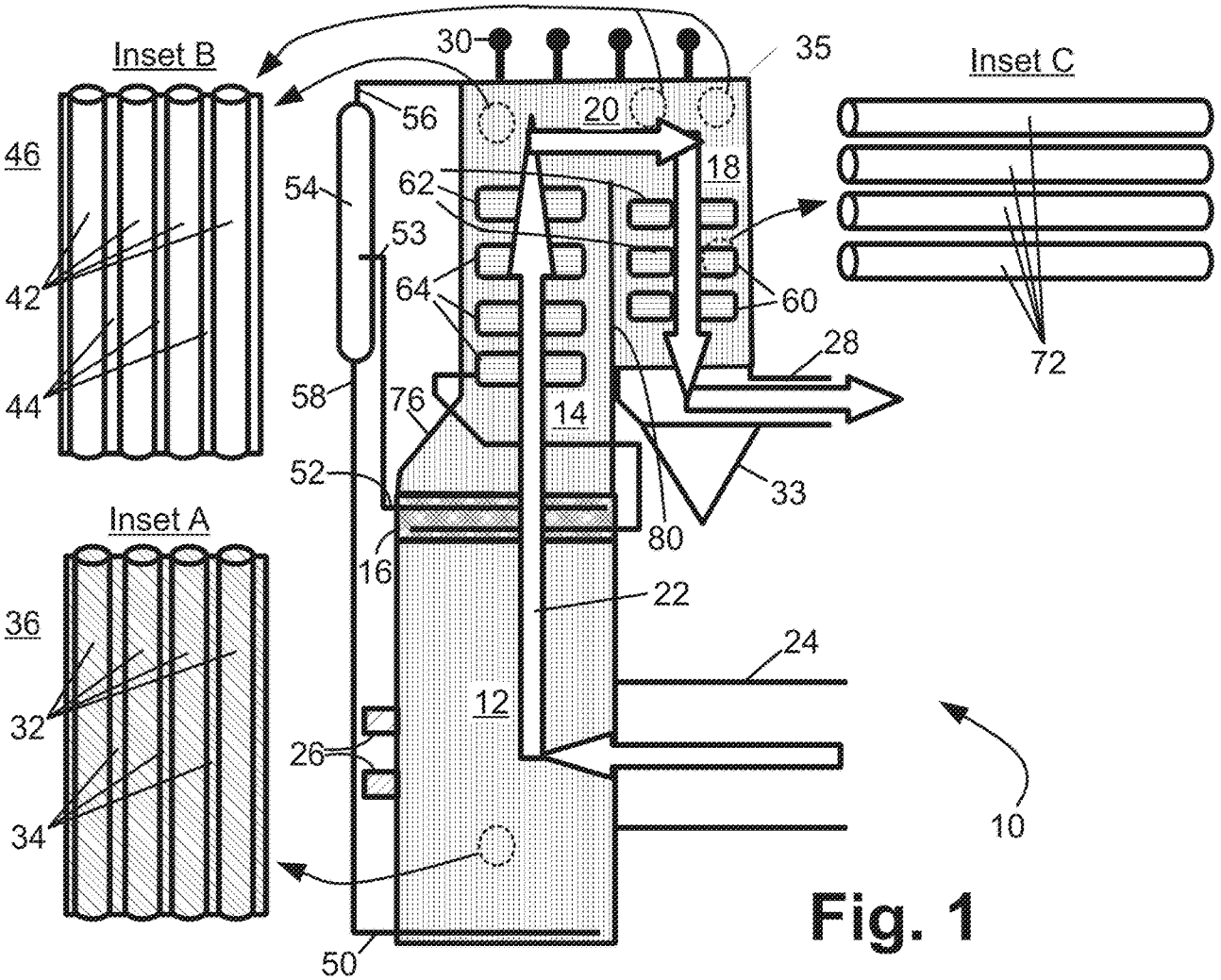
FIG. 1 diagrammatically shows a side-sectional view of an illustrative boiler. Insets A, B, and C illustrate portions of piping.

A more complete understanding of the processes and apparatuses disclosed herein can be obtained by reference to the accompanying drawings. These figures are merely schematic representations based on convenience and the ease of demonstrating the existing art and/or the present development, and are, therefore, not intended to indicate relative size and dimensions of the assemblies or components thereof.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value. For example, the term "about 2" also discloses the value "2" and the range "from about 2 to about 4" also discloses the range "from 2 to 4."

It should be noted that many of the terms used herein are relative terms. For example, the terms "inlet" and "outlet" are relative to a direction of flow, and should not be construed as requiring a particular orientation or location of the structure. The terms "upstream" and "downstream" are relative to the direction in which a fluid flows through various components, i.e. the fluid flows through an upstream component prior to flowing through the downstream component. It should be noted that in a loop, a first component can be described as being both upstream of and downstream of a second component. Similarly, the terms "upper" and "lower" are relative to each other in location, i.e. an upper component is located at a higher elevation than a lower component.

The terms "horizontal" and "vertical" are used to indicate direction relative to an absolute reference, i.e. ground level. However, these terms should not be construed to require structures to be absolutely parallel or absolutely perpendicular to each other. For example, a first vertical structure and a second vertical structure are not necessarily parallel to each other.

The terms "top" and "bottom" or the terms "roof" and "floor" are used to refer to locations/surfaces where the top/roof is always higher than the bottom/floor relative to an absolute reference, i.e. the surface of the earth. The terms "upwards" and "downwards" are also relative to an absolute reference; an upwards flow is always against the gravity of the earth.

The term "plane" is used herein to refer generally to a common level, and should be construed as referring to a volume, not as a flat surface.

A fluid at a temperature that is above its saturation temperature at a given pressure is considered to be "superheated." The temperature of a superheated fluid can be lowered (i.e. transfer energy) without changing the phase of the fluid. As used herein, the term "wet steam" refers to a saturated steam/water mixture (i.e., steam with less than 100% quality where quality is percent steam content by mass). The terms "wet steam" and "water" may be used interchangeably to describe any steam/water mixture that contains from 0% to about 80% steam (i.e. 20% to 100% water). As used herein, the term "dry steam" refers to steam having a quality equal to greater than 100% (i.e., no liquid water is present).

The terms "pipes" and "tubes" are used interchangeably herein to refer to a hollow cylindrical shape, as is commonly understood.

The term "natural circulation", as used herein, refers to the circulation of water through the boiler due to differences in density as the water is heated. Water circulation can occur without the need for a mechanical pump.

To the extent that explanations of certain terminology or principles of the boiler and/or steam generator arts may be necessary to understand the present disclosure, the reader is referred to *Steam/its generation and use,* 42nd Edition, edited by G. L. Tomei, Copyright 2015, The Babcock & Wilcox Company, ISBN 978-0-9634570-2-8, the text of which is hereby incorporated by reference as though fully set forth herein.

In a small boiler using only water-cooled furnace walls, it is difficult or impossible to achieve superheater and reheater outlet temperatures both at 1050° F. for 150-300 MW net power generation, because it is not possible to provide sufficient superheater/reheater surface area for heat transfer to the dry steam to obtain such high temperatures.

One possible alternative is to employ a drumless once-through boiler design, such as one of the Babcock & Wilcox Universal Pressure boiler designs. However, these designs employ once-through steam generation. In a once-through design, the transition point from wet steam to superheated steam depends on operating conditions, rather than being defined using a steam separator (e.g. a steam drum). As a result, more expensive piping is typically used for all piping/tubing in such once-through designs for safety. This results in increased capital costs.

In the sub-critical boiler designs of the present disclosure, the furnace is divided into two sections: a lower furnace using water-cooled membrane walls that feeds into the steam separator, and an upper furnace using steam-cooled membrane walls that is fed (directly or indirectly) by the dry steam outlet of the steam separator. This approach advantageously enables lower cost carbon steel to be used for the lower furnace walls, with more expensive piping being used only in the upper steam-cooled furnace (including the convection path walls in some embodiments). Cost is lowered by retaining the steam separator. A higher steam output temperature is attainable because the use of a steam-cooled upper furnace and convection pass walls provides additional surface area for heat transfer from combustion/flue gases to the dry steam within the steam-cooled walls, resulting in superheated steam of desired temperatures. Again, such high superheated steam temperatures cannot be obtained with conventional water-cooled walls in the upper furnace.

In some embodiments, further improvement is attained in such a design by reducing the cross-section of the upper steam-cooled furnace compared with the lower water-cooled furnace. This increases flue gas flow velocity in the upper steam-cooled furnace compared with the lower water-cooled furnace, which provides more efficient heat transfer in the high temperature gas path, and also reduces the amount of materials and manufacturing cost.

In Carolina-Type Radiant Boiler designs, the convection pass is spaced apart from the furnace by a horizontal convection pass whose horizontal length creates spacing between the furnace and the convection pass. As a result, in the Carolina-Type Radiant Boiler design, the furnace includes a rear wall and the convection pass includes a front wall. In a folded design, these two walls are combined into one wall. In the present disclosure, a common membraned steam-cooled wall is used to separate the upper furnace up-pass and the adjacent convection pass. This eliminates the open pass between the furnace and the convection pass, providing improved compactness for the boiler and reduces the amount of materials and manufacturing cost.

These benefits set forth above are attained by replacing the conventional water-cooled furnace with a two-part design in which the upper furnace is steam-cooled. However, such a modification has certain potential disadvantages. Overall material cost is increased due to the higher-cost alloys used in the upper furnace, but this can be mitigated by approaches disclosed herein (e.g., reduced upper furnace cross-section, employing a common steam-cooled wall between the furnace and the convection pass). Another potential disadvantage is structural complications for the preferred top-supported arrangement. This potentially arises because the lower furnace pipes are preferably carbon steel to reduce cost, while the upper furnace pipes are higher cost alloys for compatibility with steam cooling. Such a difficulty is also encountered in some once-through super-critical furnaces that employ carbon steel pipes in a lower furnace section to reduce cost. An example of such a design is the Babcock & Wilcox Spiral Wound Universal Pressure (SWUP) Boiler. In the SWUP once-through super-critical boiler design, the lower water-cooled furnace portion is top-supported via dedicated lower furnace support components that connect with the upper boiler support via an array of vertical tie rods and/or connections to the upper furnace water-cooled pipes. The resulting assembly is complicated as the lower furnace must be secured by installing its support components, followed by performing the pipe welding.

Such an approach employing dedicated lower furnace support components can also be employed in sub-critical boiler designs with an upper steam-cooled furnace and lower water-cooled furnace, as disclosed herein. However, in some embodiments disclosed herein, such dedicated support components and concomitant complex pipe welding operations are eliminated, and in their place a transition section with integral transition piping is employed. The transition section contains both water pipes and steam pipes, and provides a location where these pipes can be run to headers. In the transition section, at least some transition pipes are designed to be vertically oriented pipes, and lower furnace support is achieved by tensile support via welds to these vertically oriented transition pipes. The transition section can be made of a high alloy steel material that is compatible with steam-cooling—it is therefore overdesigned for the water-cooled transition pipes, but the ability to maintain top support for the lower furnace outweighs the additional cost entailed by overdesigning these relatively short water-cooled transition pipes. The transition section also acts as a pressure seal between the furnace and the atmosphere.

Some illustrative embodiments of such sub-critical boilers are diagrammatically shown and described below. These are merely illustrative examples, and a given embodiment may include one, two, more, or all disclosed novel features described herein.

Figure 2:
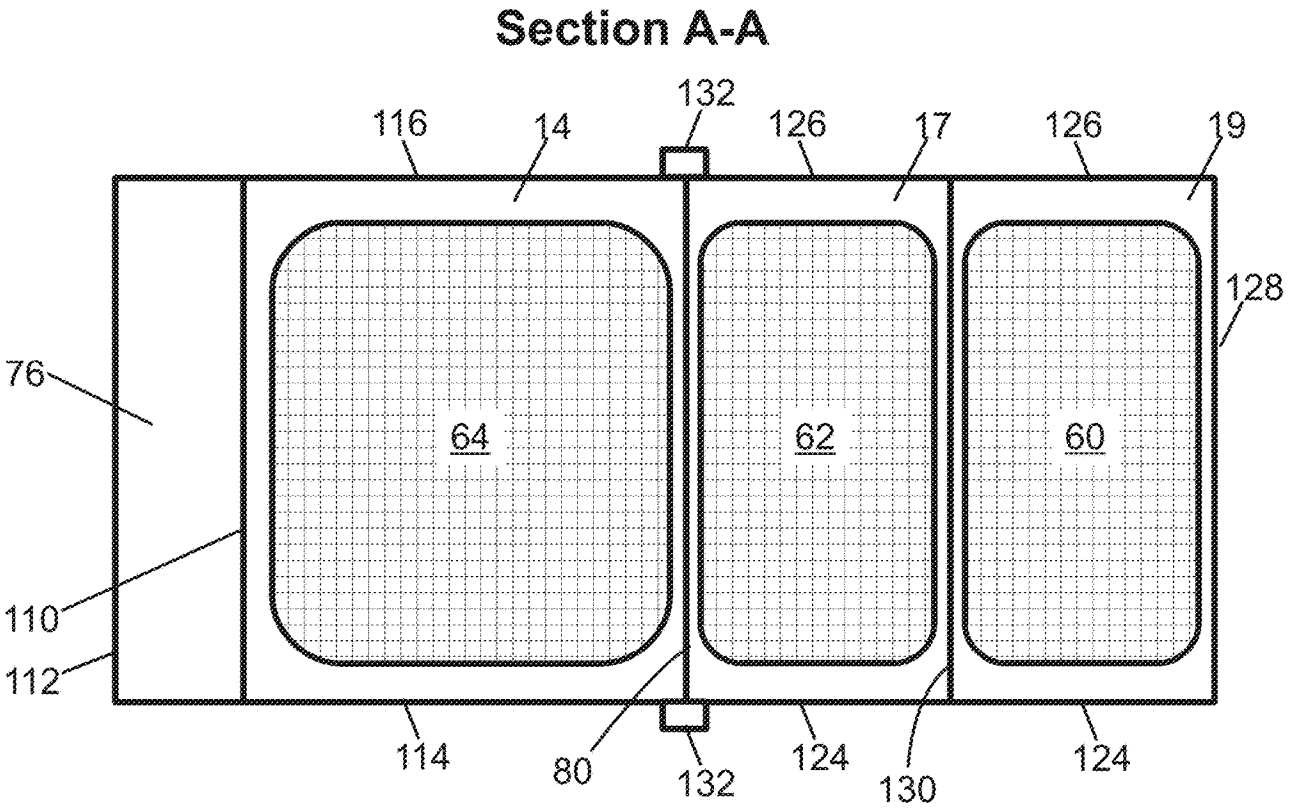
FIG. 2 is a top cross-sectional view of the boiler of FIG. 1 through the upper furnace along line A-A of FIG. 3.

FIG. 1 and FIG. 2 show different views of an illustrative sub-critical natural circulation boiler of the present disclosure. FIG. 1 is a side-sectional view of the entire boiler. FIG. 2 is a top (plan) view that passes through the upper furnace of the boiler.

With reference to FIG. 1, a sub-critical boiler 10 is diagrammatically shown. The boiler 10 includes a lower furnace 12 which is water-cooled, an upper furnace 14 which is steam-cooled, and a transitional section 16 which in preferred embodiments is formed from a single-piece transition casting. The illustrative boiler 10 is a folded boiler design that further includes a convection pass 18 which is connected to the upper furnace 14 to form what might be considered a horizontal pass 20. The walls of the lower furnace 12, the transitional section 16, the upper furnace 14, and the convection pass 18 collectively define the boiler.

Combustion/flue gas 22 are diagrammatically indicated by arrows, and these gases flow through the boiler and heat the water/steam in the various walls of the boiler. More specifically, combustion air is blown into the lower furnace 12 through an air inlet 24, where it is mixed with a combustible fuel such as coal, oil, or natural gas. In some preferred embodiments, the fuel is coal, which is pulverized by a pulverizer (not shown). A plurality of burners 26 combusts the fuel/air mixture, resulting in flue gas. The flue gas rises by natural convection through the up-pass formed by the lower furnace 12, the transition section 16, and the upper furnace 14, then flows horizontally through the convection pass, which includes the convection pass 18 and finally exits through a flue gas outlet 28 for further downstream processing. Preferably, a hopper 33 is provided to capture ash or other contaminants in the exiting flue gas.

The sub-critical boiler 10 is top-supported to the building structure via suitable upper anchor points 30. These are diagrammatically indicated in FIG. 1. The pipes of the upper furnace 14 and the convection pass 18 are vertically oriented and are directly supported from the anchor points 30. The pipes of the lower furnace 12 are also vertically oriented and are directly supported via welds to the transition section 16.

It is desirable to capture the heat energy present in the combustion/flue gas 22 for tasks such as driving an electrical power generation turbine (for example). To do so, the sub-critical boiler 10 includes cooling surfaces comprising pipes or tubes through which wet steam flows (these pipes or tubes are referred to herein as water-cooled) or through which superheated steam flows (these pipes or tubes are referred to herein as steam-cooled). More particularly, with reference to Inset A of FIG. 1, the lower furnace 12 includes water-cooled tubes 32 with membrane 34 disposed between and welded to the tubes 32, so that the tubes 32 and membrane 34 collectively form a membrane wall 36, with the tubes 32 carrying flow of wet steam through the membrane wall 36. The membrane wall 36 forms the barrier that contains the flue gas 22, i.e. the membrane 34 is welded or otherwise connected to the tubes 32 to provide a seal against leakage of the flue gas 22. The water-cooled membrane wall 36 of the lower furnace 12 does not see highly elevated water temperatures; for example, if the sub-critical boiler 10 is designed for a maximum steam pressure of 2800 psig, then the saturated steam carried by the water-cooled tubes 32 is at about 685° F. (corresponding to the boiling point of water at 2800 psig), though of course the combustion gas is at a much higher temperature.

The upper furnace 14 and convection pass 18 are analogously made of a steam-cooled membrane wall 46 comprising steam-cooled tubes 42 with membrane 44 disposed between and welded or otherwise connected to the tubes 42 (see Inset B of FIG. 1), with the tubes 42 and membrane 44 collectively forming the membrane wall 46. The tubes 42 carry a flow of superheated steam through the membrane wall 46. The steam-cooled membrane wall 46 carries steam at substantially higher steam temperature than the water-cooled membrane wall 36. For example, the steam in the steam-cooled membrane walls 46 may be at a temperature of over 1000° F., e.g. up to 1100° F. in some contemplated embodiments. It should be noted that the roof 35 of the furnace and the convection pass is also made of steam-cooled membrane wall. It should also be noted that the diameter of the tubes and the spacing between the tubes of the steam-cooled membrane walls may differ between the upper furnace and the convection pass.

The tubes 32 of the water-cooled membrane wall generally have a greater diameter than the tubes 42 of the steam-cooled membrane wall. In particular, embodiments, the inner diameter of the water-cooled tubes is at least 0.5 inches greater than the inner diameter of the steam-cooled tubes. The tubes of the water-cooled membrane wall have an inner diameter of about 1.5 inches to about 2.0 inches, while the tubes of the steam-cooled membrane wall have an inner diameter of about 1.0 inches to about 2.5 inches. The tubes of the water-cooled membrane wall have an outer diameter of about 2.0 inches to about 2.5 inches, while the tubes of the steam-cooled membrane wall have an outer diameter of about 1.3 inches to about 2.3 inches. The tubes themselves may have a thickness of about 0.2 inches to about 0.5 inches.

In a typical steam flow circuit for the sub-critical boiler 10, water is inputted to the lower ends of the water-cooled tubes 32 via a lower inlet header 50. As the water travels upwards through these water-cooled tubes 32, the water cools the tubes exposed to high-temperature flue gas in the lower furnace 12 and absorbs energy from the flue gas to become a steam-water mixture (i.e. wet steam) at subcritical pressure.

The wet steam exits the upper ends of the water-cooled tubes 32 and flows via a wet steam outlet header 52 into an inlet 53 of a steam separator 54. The wet steam outlet header 52 is preferably welded to water-cooled transition pipes within the transition section 16. Preferably, the wet steam outlet header 52 facilitates venting of the tubes 32 as appropriate during start up, shut down, or maintenance, etc. Any type of steam separator may be used, e.g. employing cyclonic separation or so forth. In particular embodiments, a vertical steam separator is used, such as that described in U.S. Pat. No. 6,336,429. A dry steam outlet 56 of the steam separator 54 at an upper end of the steam separator outputs substantially dry steam (i.e., steam with 100% quality). A drain or water outlet 58 near the lower end of the steam separator 54 collects water extracted from the wet steam for recycle back to the lower inlet header 50 feeding the lower furnace 12.

The steam output from the dry steam outlet 56 flows the convection pass 18 and then to the upper furnace 14. To provide additional surface for heat transfer, one or more primary superheaters 60, re-heaters 62, and/or secondary superheaters 64 may be provided in the interior volume of the boiler, within the upper furnace 14 and the convection pass 18. As illustrated here, one or more superheaters 60 disposed in the convection pass 18; one or more re-heaters (or re-heating superheaters) 62 are disposed in the convection pass 18 and/or in the upper furnace 14; and one or more secondary superheaters 64 are disposed in the upper furnace 14. Again, the steam-cooled furnace walls 46 of the upper furnace 14 act as superheater surfaces as well. A more detailed illustrative steam circuit is described in later drawings. It is to be understood that the illustrative steam circuit is merely an example, and other steam circuit configurations are contemplated, e.g. various superheater components may be omitted, and/or located elsewhere, etc.

Unlike the membrane walls 46 of the steam-cooled upper furnace 14 and the convection pass 18, the superheaters 60, 62, 64 located within the boiler are formed from loose pipes/tubes 72 without membrane joining the tubes together (see Inset C of FIG. 1). These superheaters 60, 62, 64 are disposed in the interior of the flue boiler, and desirably permit flue gas to pass through them, increasing the surface area through which heat transfer from the flue gas to the steam within the pipes can occur. The superheater pipes 72 are preferably made of an alloy steel material. In some embodiments, the superheater pipes 72 and the steam-cooled membrane wall 46 are made of the same alloy steel material, although this is not required.

As seen in FIG. 1, the superheaters 60, 62, 64 are surrounded by the steam-cooled membrane walls 46. Said another way, the superheaters 60, 62, 64 are contained within the upper furnace 14 and/or in the convection pass 18 as shown in the illustrative boiler 10 of FIG. 1. The steam within the steam-cooled membrane walls 46 may be at the same or higher temperature than in the superheaters 60, 62, 64. Due to the additional surface area available for heat transfer from the flue gas to the superheated steam within the various superheating surfaces 46, 60, 62, 64, the boiler 10 can achieve higher superheated steam temperatures than would be achievable with a conventional water-cooled sub-critical boiler whose furnace walls are entirely cooled by wet steam flowing through water-cooled pipes. However, the sub-critical boiler 10 retains the general layout of a sub-critical boiler, including employing the steam separator 54 disposed (in a steam flow sense) between the wet steam sub-circuit and the superheated steam sub-circuit, thus retaining advantages such as the operational flexibility of a sub-critical boiler design.

The illustrative sub-critical boiler 10 employs certain features that enhance compactness and efficiency. One feature is a reduced cross-sectional area for the combustion/flue gas flow 22 through the upper furnace 14 compared with the lower furnace 12. The referenced cross-sectional area is the horizontal cross-section in the illustrative design in which the flue gas 22 flows vertically upward. In the illustrative boiler 10, the reduction in cross-sectional area of the upper furnace 14 relative to the lower furnace 12 is obtained via a "arch" surface 76, which is slanted as the upper furnace continues upward from the transition section 16, to reduce turbulence at the transition to higher flow velocity. This has at least two benefits. First, the reduced cross-sectional area of the upper furnace 14 reduces the amount of material (e.g. total surface area of membrane wall 46) which reduces capital cost. Second, the higher velocity of the flue gas flow 22 due to the reduced cross-sectional area increases the efficiency of heat transfer to the steam-cooled pipes 42, 72. The transition section 16 is located below the arch 76. The arch 76 is part of the upper furnace, and is also a steam-cooled membrane wall.

FIG. 2 is a cross-sectional plan (top) view of the boiler 10 through the upper furnace 14, and provides another view of the various components. The front wall 110 of the upper furnace is shown in solid line, as is the front wall 112 of the lower furnace. The area between these two walls is the arch 76. The upper furnace includes a first side wall 114 and a second side wall 116 opposite the first side wall, both of which are made of steam-cooled membrane walls 42. The fourth side of the upper furnace is defined by a common steam-cooled membrane wall 80. The convection pass is defined by a first side wall 124, a second side wall 126 opposite the first side wall, and a rear wall 128. A baffle wall 130 divides the convection pass into a front convection pass 17 and a rear convection pass 19. A primary superheater 60 is seen in the rear convection pass 19, while a reheater 62 is seen in the front convection pass 17 and a secondary superheater 64 is seen within the upper furnace 14.

Another feature that enhances the compactness and efficiency of this boiler design is the use of a common steam-cooled membrane wall 80. The common steam-cooled membrane wall 80 is both a "rear" wall of the upper furnace 14 and a "front" wall of the convection pass 18. The upper furnace 14 and the convection pass 18 thus share the common steam-cooled membrane wall 80, which comprises a single layer of pipes sealed by a single layer of membrane disposed between and connected to the single layer of pipes. The use of the common steam-cooled membrane wall 80 has numerous advantages. The usual open pass between the furnace and the convection pass is eliminated, providing a more compact design and reducing capital costs due to lower surface area. The common steam-cooled membrane wall 80 is advantageously heated both by flue gas flowing upward through the upper furnace 14 and by flue gas flowing downward through the convection pass 18.

One issue with employing the common steam-cooled membrane wall 80 is the large temperature variation between the flue gas temperature in the upper furnace 14, on the one hand, and the flue gas temperature in the convection pass 18 on the other hand. This differential between the two flue gas temperatures will be felt by the common steam-cooled membrane wall 80. Using transient modeling and finite element analysis to determine the resulting stress in the walls of the boiler, it was found that maximum thermal differential stress occurs during start-up, and more particularly occurs in a small area at the bottom of the common steam-cooled membrane wall 80, adjacent walls 114, 124 on one side and walls 116, 126 on the other. Intuitively, this can be understood since this bottommost part of the common steam-cooled membrane wall 80 is where there is the greatest temperature differential between the upward flue gas flow in the upper furnace 14 and the downward flue gas flow in the convection pass 18. This stress can cause boiler bowing/tearing, and is accommodated by providing seals at the junction of the bottom of the common steam-cooled membrane wall 80, the furnace side walls 114, 116, and the convection pass side walls 124, 126, as analysis showed that the overstressed area does not extend significantly up the common steam-cooled membrane wall 80. These seals are illustrated in FIG. 2 with reference numeral 132.

It should be noted that the various improvements disclosed herein can be used to advantage individually or in various combinations, and/or in various types of boilers. For example, the disclosed common steam-cooled membrane wall 80 can also be used to advantage in a once-through boiler design having a convection pass, or in other types of boilers having two neighboring steam-cooled membrane walls.

Figure 3:
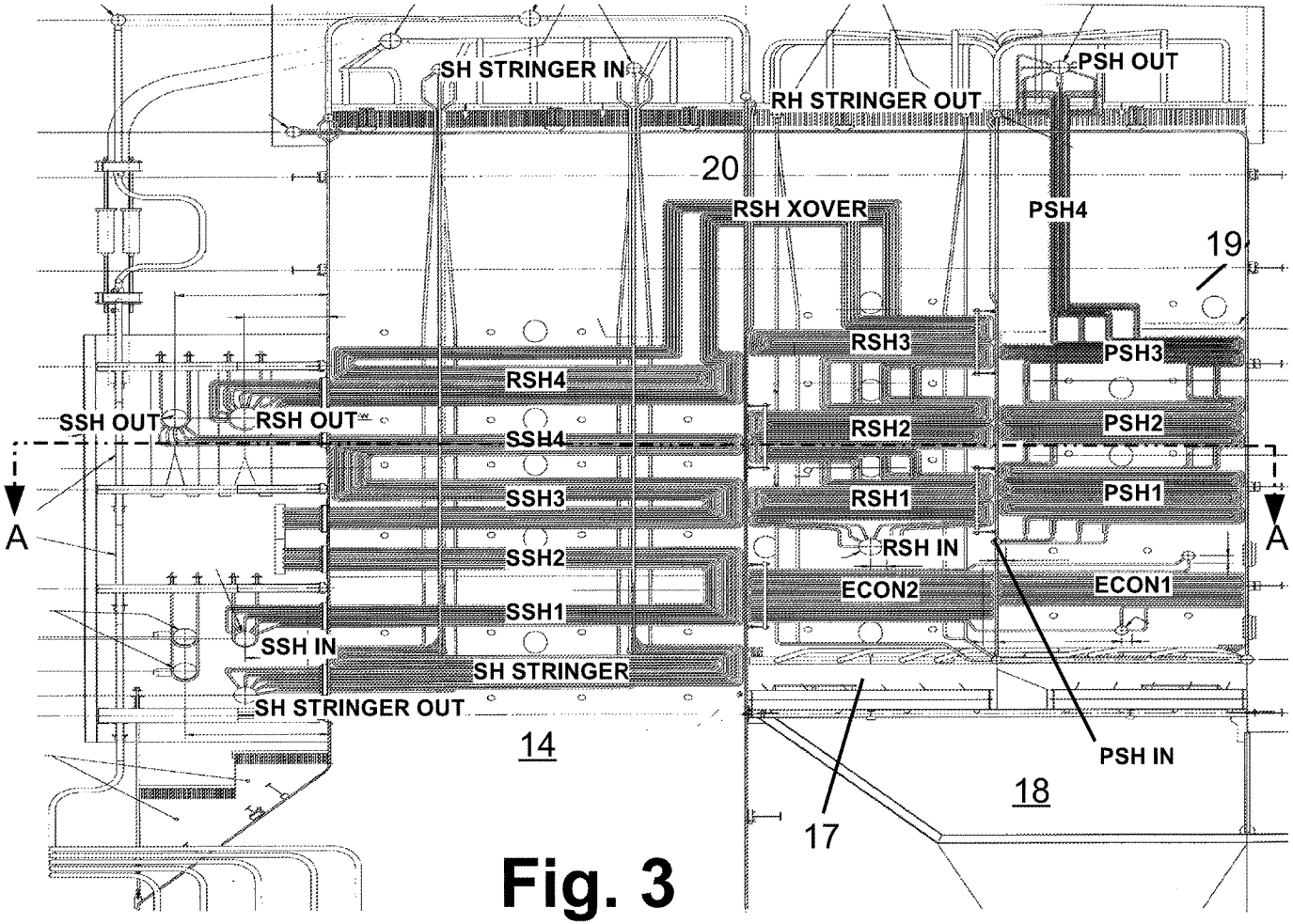
FIG. 3 diagrammatically shows a more detailed side-sectional view of a portion of the boiler of FIG. 1 including an illustrative layout of superheaters.
Figure 4:
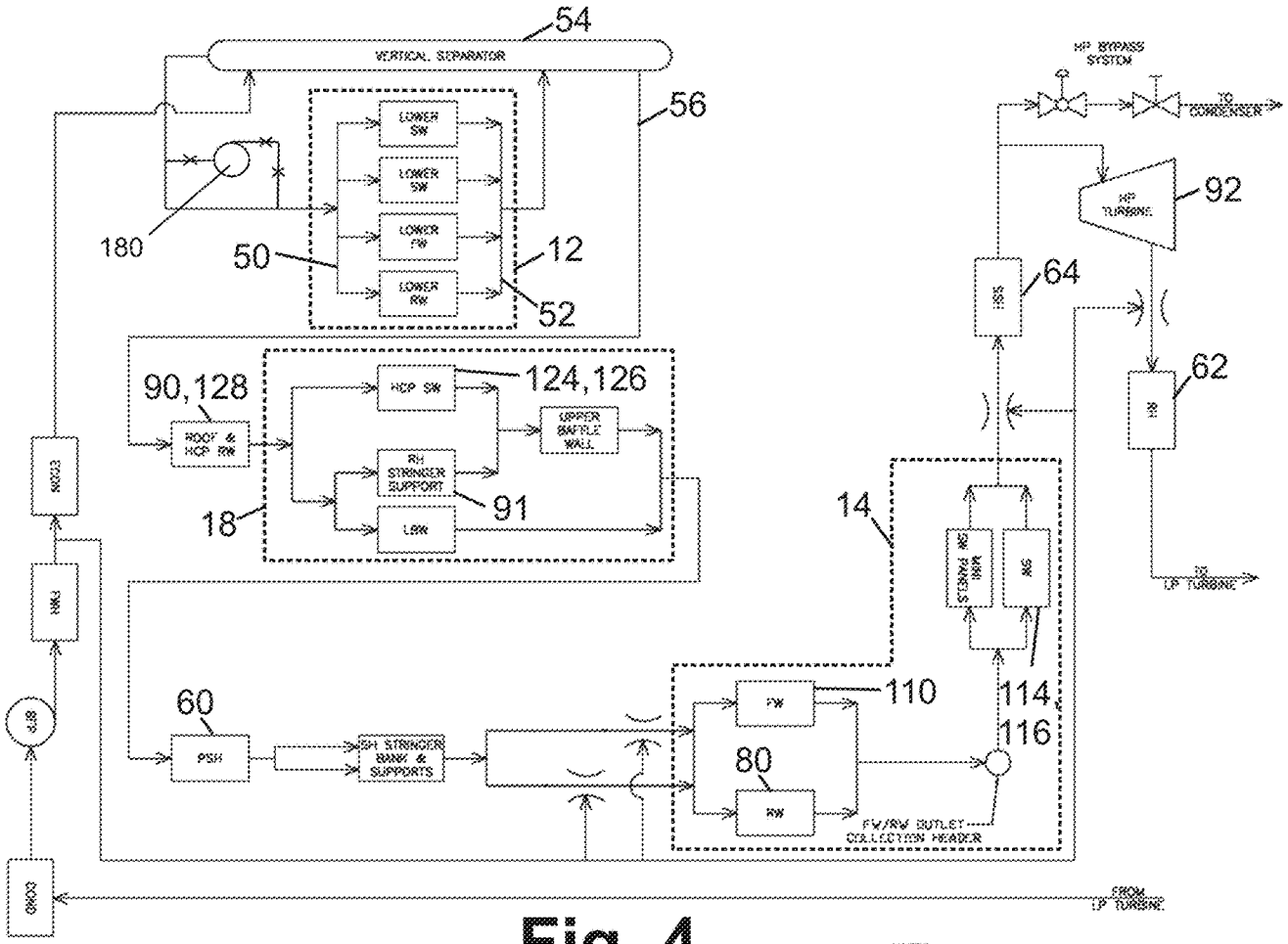
FIG. 4 diagrammatically shows a cooling circuit of the boiler of FIG. 1 and FIG. 2.

With reference now to FIGS. 2-4, an illustrative steam-cooled circuit is described that may be used in the boiler 10 of FIG. 1. FIG. 3 shows a side-sectional view of the upper furnace 14, the convection pass 18, and the horizontal pass 20 connecting them. Also shown are more detailed renderings of the primary superheaters 60, reheaters 62, and secondary superheaters 64. In FIG. 3 and FIG. 4, the primary superheaters 60 are labeled using the prefix "PSH"; the reheaters (i.e. re-heating superheaters) are labeled using the prefix "RSH"; and the secondary superheaters are labeled using the prefix "SSH". Additionally, economizers are shown, indicated by the prefix "ECON". Inlet headers are indicated by the suffix "IN" while outlet headers are indicated by the suffix "OUT".

As shown in FIG. 3, there are four primary superheaters disposed in the rear convection pass 19. Three of these employ horizontal tubes, and from lowest to highest elevation are indicated as PSH1, PSH2, and PSH3. The fourth primary superheater PSH4 is at the highest elevation and employs vertical pipes. Flow through the primary superheaters is in sequential order by number, upward through the convection pass, and the superheated steam exits at the PSH OUT header at the roof of the boiler.

Four reheaters RSH1, RSH2, RSH3, and RSH4 are also employed. Three of these (RSH1, RSH2, and RSH3) are disposed in the front convection pass 17, while the fourth reheater RSH4 is disposed near the top of the upper furnace 14. Cross-over piping labeled RSH XOVER conveys steam from RSH3 in the convection pass 18 to RSH4 in the upper furnace 14. Steam flow is from a lower inlet header RSH IN, through the reheaters in sequential order, to an outlet header RSH OUT shown to the left of the upper furnace 14 in FIG. 3.

Four secondary superheaters SSH1, SSH2, SSH3, and SSH4 are disposed in the upper furnace 14 below the fourth re-heater RSH4. Superheated steam flows from the PSH OUT header to the SSH IN header shown to the left of the upper furnace 14, then upwards successively through SSH1, SSH2, SSH3, and SSH4 and to the SSH OUT header again shown to the left of the upper furnace 14 above the SSH IN header.

The steam-cooled circuit further includes superheater stringers denoted SH STRINGER in FIG. 3, which are fed from SH STRINGER IN headers at the top of the upper furnace and subsequently flow to the SH STRINGER OUT outlet header. These stringers support the secondary superheaters. Similarly, reheater stringers are visible which support the reheaters in the front convection pass.

Referring now to FIG. 4, a more detailed illustration of the components that form the steam-cooled circuit and their interconnections is shown. The steam-cooled circuit starts at the dry steam outlet 56 of the steam separator 54. Going downstream from the steam separator, dry steam running downstream first flows from the dry steam outlet 56 across the roof 90 of the boiler 10. Dry steam also flows down the rear wall 128 of the convection pass 18. The dry steam that flowed down the rear wall 128 then flows up the convection pass side walls 124, 126 and the reheater stringer supports 91, and then back down the upper baffle wall. The dry steam from the roof 90 of the boiler flows up the lower baffle wall.

The two dry superheated steam streams from the upper baffle wall and the lower baffle wall are then combined and flow into the primary superheaters 60 (i.e. PSH1, PSH2, PSH3, PSH4 in FIG. 3). Please note the superheated steam travels through all four primary superheaters; the steam is not divided so that only a portion flows through each primary superheater. The superheated steam travels upwards to the PSH OUT header (see FIG. 3). The superheated steam then travels downwards through the superheater stringers (labeled SH STRINGER) in the upper furnace. From there, the superheated stream travels upwards through the upper furnace front wall 110 and the common steam-cooled membrane wall 80 (acting as the upper furnace rear wall). The superheated steam then travels upwards through the upper furnace side walls 114, 116. Next, the superheated steam travels upwards through the secondary superheaters 64. Again, the superheated steam passes through all four secondary superheaters (SSH1, SSH2, SSH3, and SSH4). After passing through the secondary superheaters, the superheated steam has a pressure of 2000 psig or greater, and in some cases 2500 psig or greater, such as about 2600 psig. The superheated steam also has a temperature of 1000° F. or greater, such as about 1050° F. The superheated steam is then sent to a high-pressure turbine 92 where the heat energy is used for electrical power generation. The superheated steam loses both temperature and pressure within the high-pressure turbine 92. The output from the high-pressure turbine is then sent back to the boiler 10 and sent through the reheaters 62. After passing through the reheaters, the steam has a pressure of 500 psig or greater, such as about 600 psig, and also has a temperature of 1000° F. or greater, such as about 1050° F. This superheated steam can then be used to run a low-pressure turbine.

Referring back to FIG. 4, water is returned from the low-pressure turbine. This water passes through a condenser (COND), a boiler feed pump (BFP), and a feedwater heater (FWH) before being sent to the economizer (ECON) to absorb residual heat energy from the flue gas exiting the convection pass. From there, the heated water from the economizer is sent to the steam separator 54. In the water-cooled circuit, water is sent from the steam separator to lower furnace inlet header 50, which feeds the water-cooled membrane walls of the lower furnace 12. Wet steam is collected from lower furnace outlet header 52 and sent to the steam separator 54 for separation into water and dry steam.

The steam-cooled circuit of FIG. 3 and FIG. 4 is merely an illustrative example, and in other embodiments the number and locations of superheaters may be different, as well as the arrangement of the various steam-cooled membrane wall and superheater components in the steam-cooled circuit. The illustrative furnace of FIG. 1 with the illustrative steam-cooled steam circuit of FIG. 3 and FIG. 4 has been modeled using 3D solid modeling software, and was determined from this analysis to provide improved performance including a 1050° F./2600 psig superheater temperature/pressure and a 1050° F./600 psig reheater temperature/pressure, for a boiler designed to provide 150 MW to 300 MW of net power.

Referring back now to FIG. 1, the transition section 16 connects the lower furnace 12 to the upper furnace 14. As previously mentioned, this allows the lower furnace to be top-supported through the transition section and the upper furnace. It should be noted that the transition section is relatively short. The transition section is only about 4 feet in total height.

Figure 5:
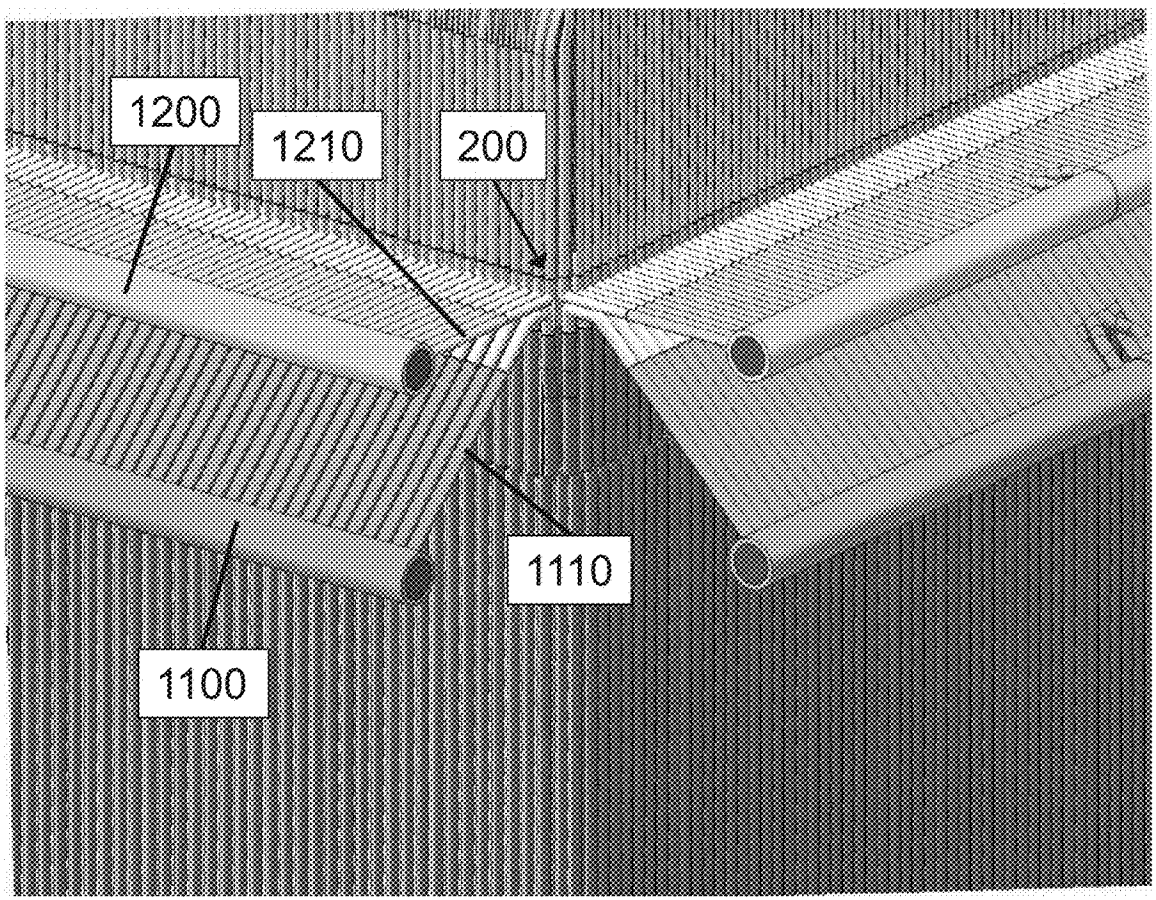
FIG. 5 is a magnified perspective view of the boiler of FIG. 1 showing the transition section with a first exemplary transition casting.

FIG. 5 is a magnified perspective view of the boiler showing a first transition section 16. In FIG. 5, the transition section includes a first exemplary transition casting 200. As will be explained in greater detail further herein, the transition casting includes steam tubes and water tubes. Dry/superheated steam flows through the steam tubes, and saturated steam (i.e. a water/steam mixture) flows through the water tubes. As can be best seen in FIG. 5, a steam inlet header 1200 is present outside the pressure boundary (i.e. on the exterior of the furnace). As shown, the steam inlet header 1200 is located in line with the transition casting 200 with steam-cooled tube 1210 connecting the transition casting 200 and steam inlet header 1200, permitting inlet header 1200 to be drainable during start-up utilizing pump 180 (FIG. 4). A water outlet header 1100 is also located outside of the pressure boundary and is located below the transition casting 200. Water-cooled tube 1110 connects the transition casting 200 to the water outlet header 1100.

Figure 6:
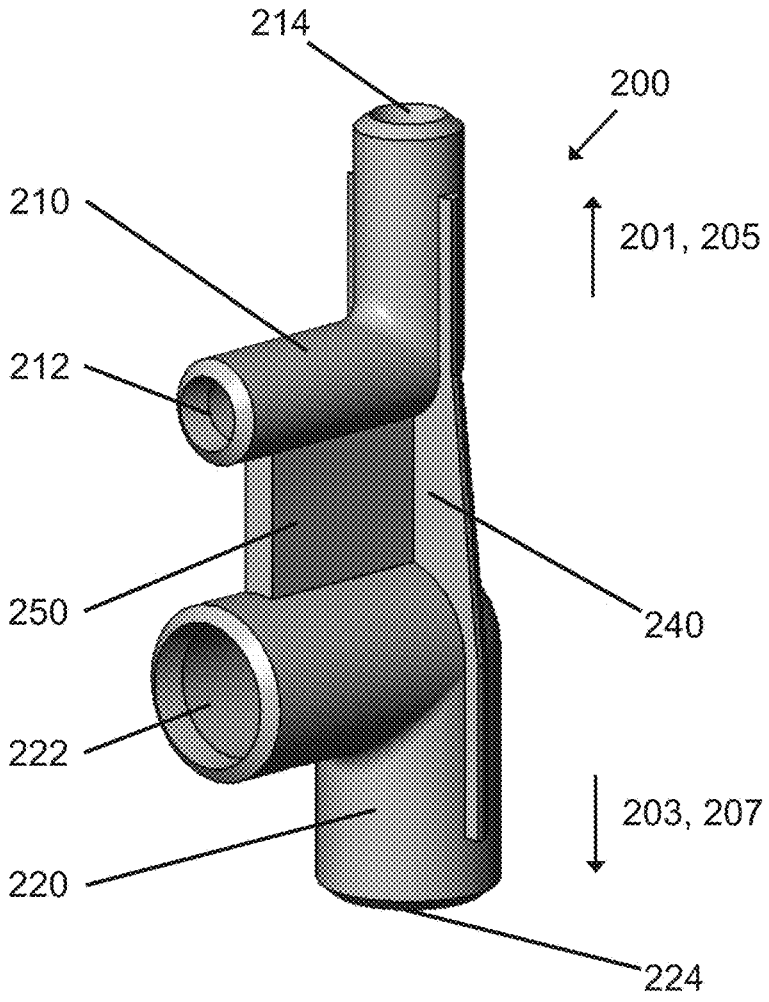
FIG. 6 is a perspective view of a first embodiment of the first exemplary transition casting.
Figure 7:
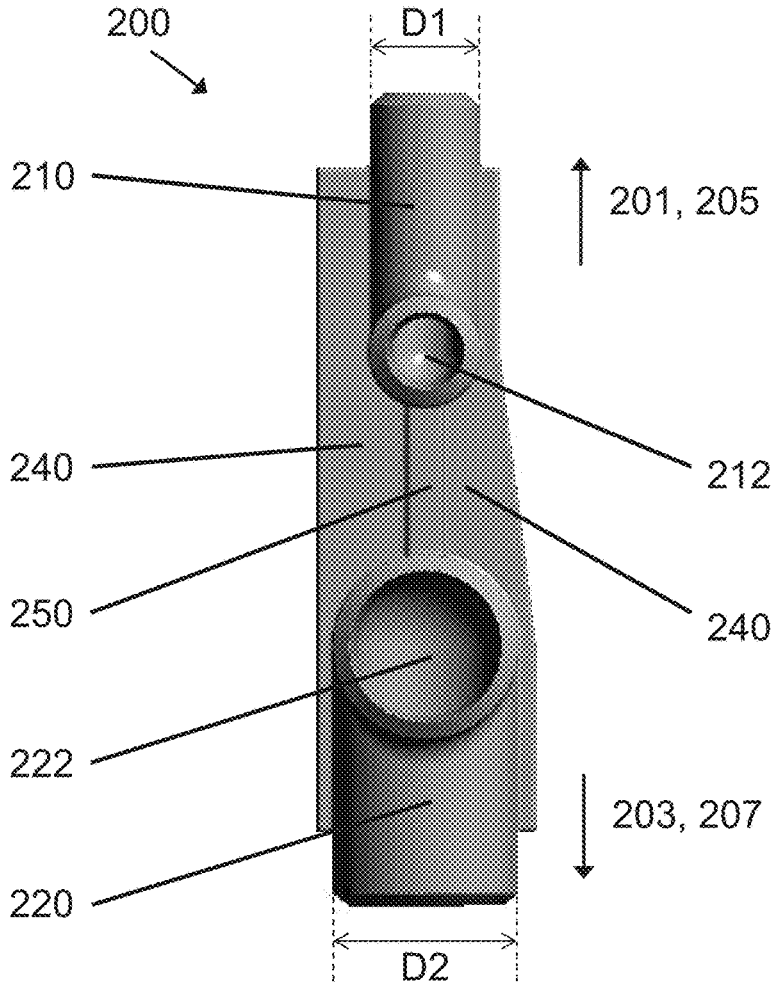
FIG. 7 is a front view of the first embodiment of the first exemplary transition casting of FIG. 6.
Figure 8:
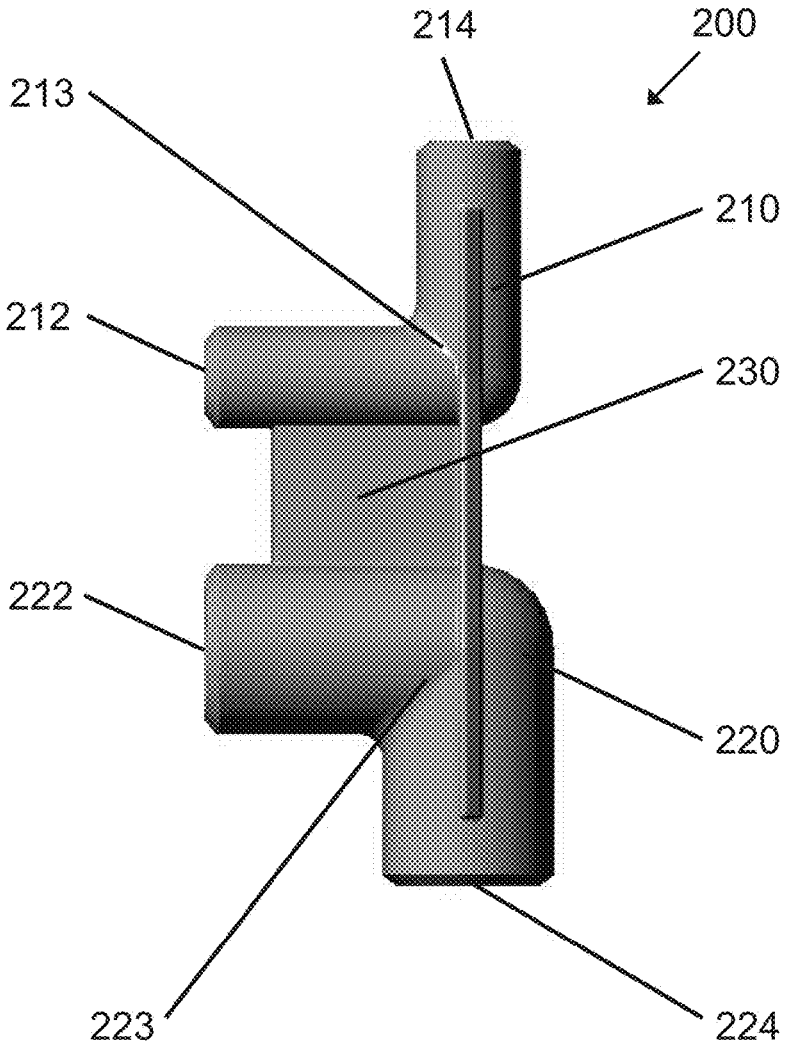
FIG. 8 is a side view of the first embodiment of the first exemplary transition casting of FIG. 6.

FIGS. 6-8 are different views of a first embodiment of a transition casting 200. FIG. 6 is a perspective view, FIG. 7 is a front view, and FIG. 8 is a side view. The various components of the first exemplary transition casting will now be described below.

Referring now to FIGS. 6-8, the transition casting 200 is broadly defined by a first steam tube 210, a first water tube 220, a membrane 240 that joins these tubes 210, 220 together to form a pressure seal, and a first heat transfer fin 250. The first steam tube 210 has a steam passageway extending between a front end 212 pointing in the forward direction (i.e. outwardly from the furnace) and a vertical end 214 pointing in a first vertical direction 201/an upper vertical direction 205. The first water tube 220 has a water passageway extending between a first end 222 and a vertical end 224 pointing in a second vertical direction 203. The second vertical direction 203 is opposite that of the first vertical direction 201, and in this case is also a lower vertical direction 207.

The first heat transfer fin 250 extends from the membrane 240 and abuts the first water tube 220. In FIGS. 6-8, the first heat transfer fin 250 also abuts the first steam tube 210. As shown here, the first heat transfer fin 250 extends between the first steam tube 210 and the first water tube 220 and may be welded to these tubes 210, 220. In this way, the first heat transfer fin 250 facilitates heat transfer between the membrane 240 and the tubes to which it abuts.

The first steam tube 210 has a steam tube diameter D1. The first water tube 220 has a water tube diameter D2. In particular embodiments, the water tube diameter D2 is greater than the steam tube diameter D1.

Figure 11:
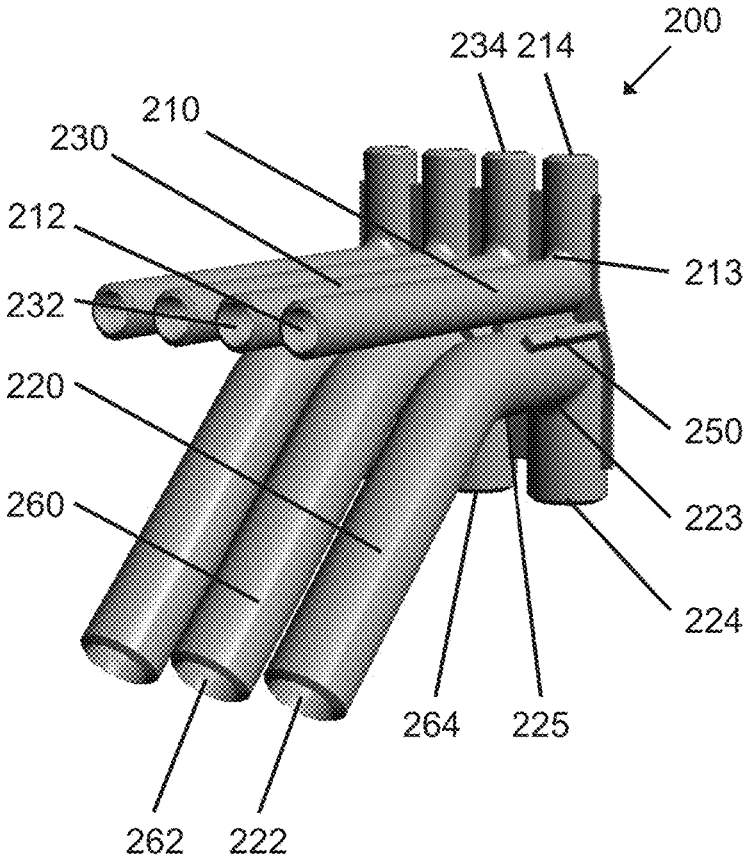
FIG. 11 is a perspective view of a third embodiment of the first exemplary transition casting.
Figure 12:
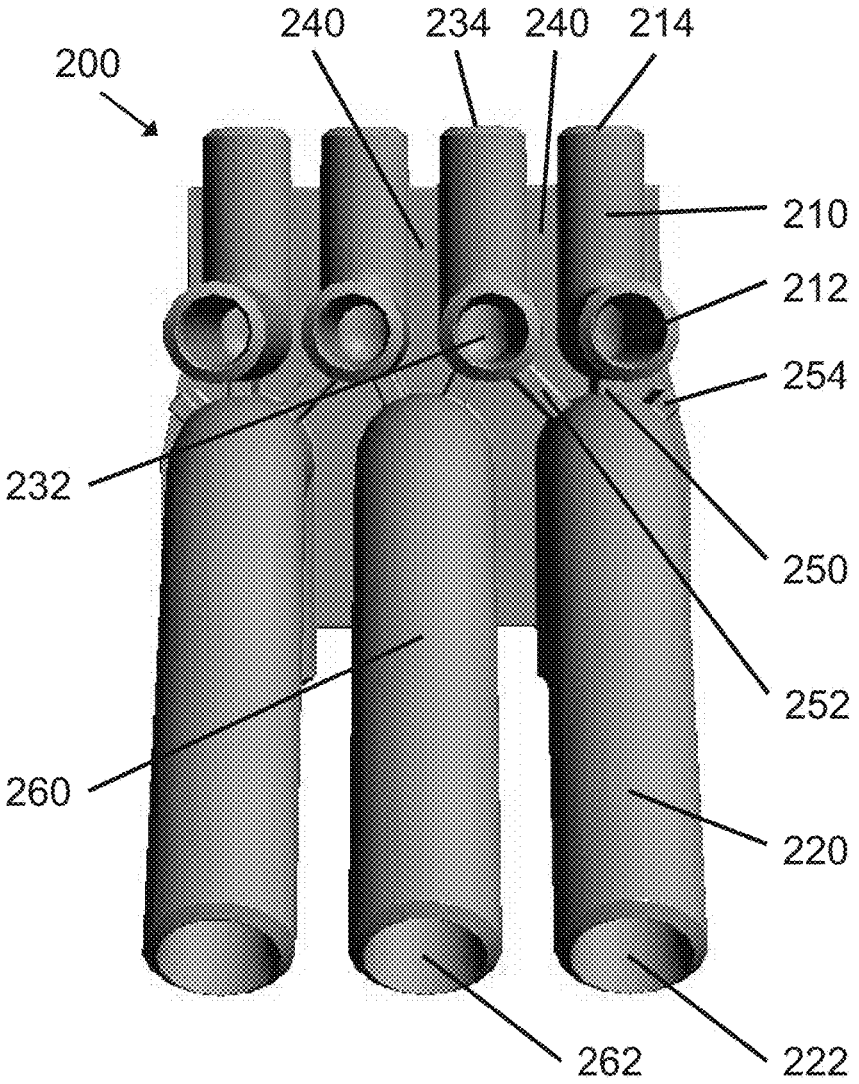
FIG. 12 is a front view of the third embodiment of the first exemplary transition casting of FIG. 11.
Figure 13:
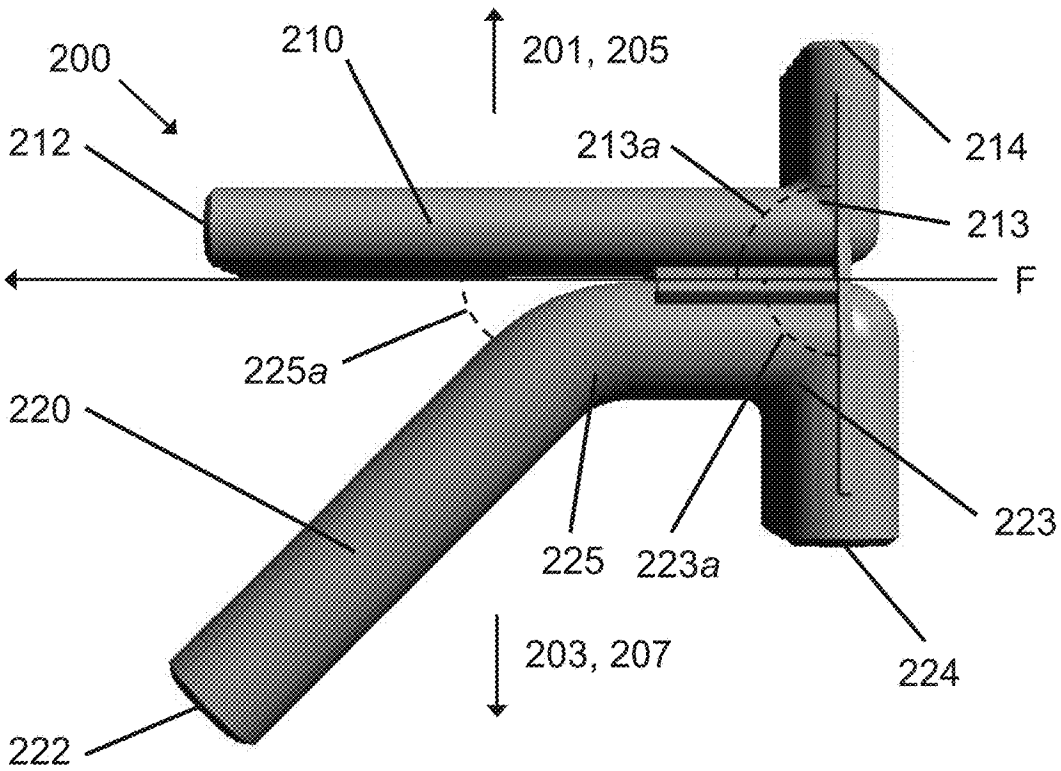
FIG. 13 is a side view of the third embodiment of the first exemplary transition casting of FIG. 11.

Referring again to FIG. 8, the water passageway of the first water tube 220 has at least one bend between the first end 222 and the vertical end 224 thereof. In the embodiment shown in FIG. 8, the first water tube 220 has exactly one bend 223. Similarly, the first steam tube 210 is shown as having a single bend 213. When the first water tube 220 has only a single bend, the first end 222 thereof may be a front end pointing in the forward direction (i.e., in the same direction as the front end 212 of the first steam tube 210). In other embodiments, the first water tube 220 may have additional bends between the first end 222 and vertical end 224 thereof. For example, FIGS. 11-13 show the first water tube 220 with a first bend 223 and a second bend 225. As can be best seen in FIG. 13, the bends may be of greater magnitudes (i.e., the angles of the bends may be different). FIG. 13 shows a horizontal axis F defined by the forward direction. The first bend 223 is shown as having an angle 223*a* of about 90° relative to the horizontal axis F. As such, the vertical end 224 of the first water tube 220 points in the second vertical direction 203/the lower vertical direction 207. The second bend 225 is shown as having an angle 225*a* of about 30° to 60°, or more particularly 45°, relative to the horizontal axis F. As such, the first end 222 of the first water tube 220 points at an angle relative to both the vertical end 224 of the first water 220 and the front end 212 of the first steam tube 210. Finally, the bend 213 in the first steam tube 210 is shown in this embodiment as having an angle 213*a* of about 90° relative to the horizontal axis F. As such, the vertical end 214 of the first steam tube 210 points in the first vertical direction 201/the upper vertical direction 205. Further, because the first steam tube 210 is shown as only having a single bend, the front end 212 of the first steam tube 210 points in the forward direction. While the tubes and their respective ends are illustrated with various bends and at various angles, it is to be understood and appreciated that the tubes may be bent and angled as desired for particular boiler configurations. For example, the presence of two bends 223, 225 in the first water tube 220 makes the first water tube 220 capable of fluidly connecting to a water outlet header that is lower than the transition casting, such as is shown in FIG. 5.

Figure 9:
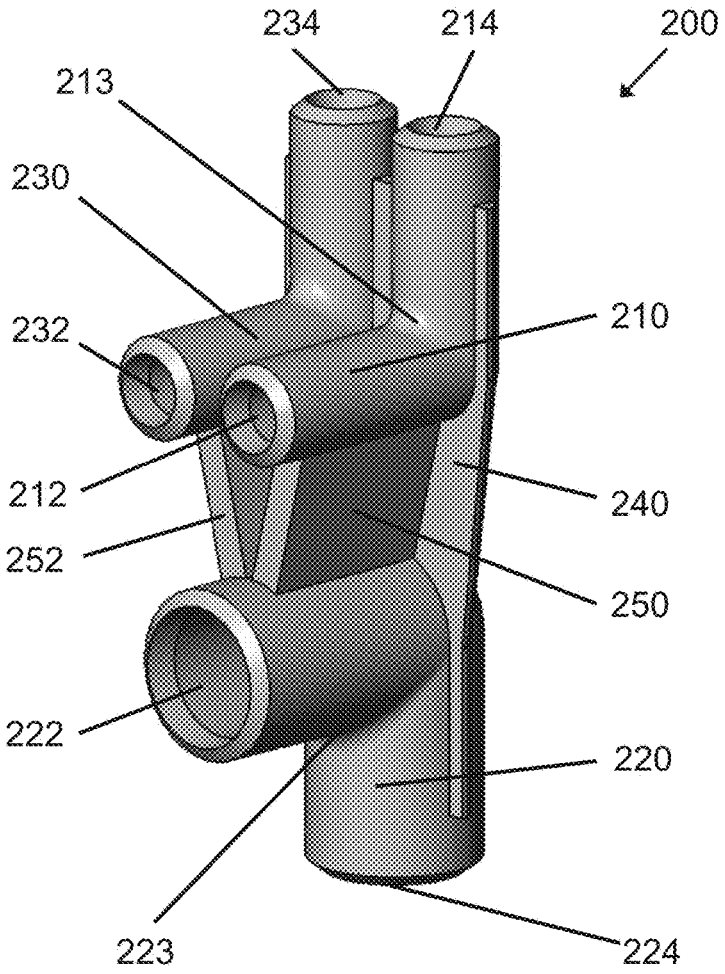
FIG. 9 is a perspective view of a second embodiment of the first exemplary transition casting.
Figure 10:
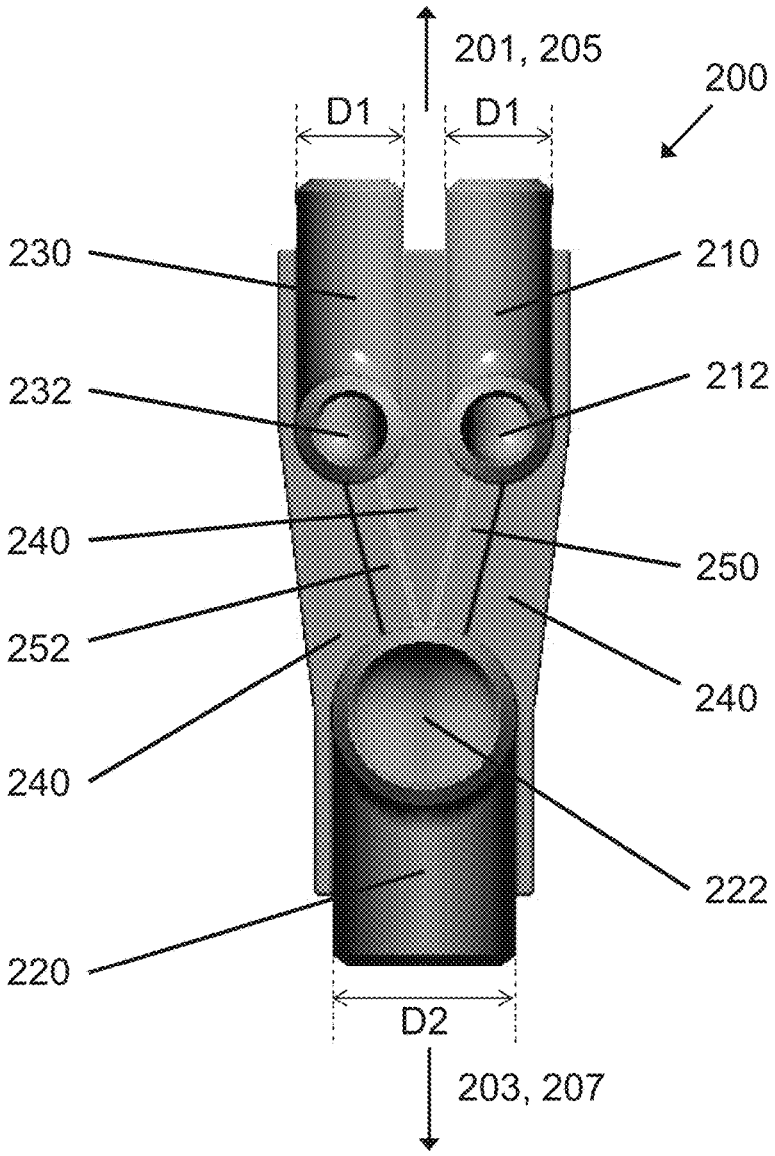
FIG. 10 is a front view of the second embodiment of the first exemplary transition casting of FIG. 9.

The transition casting 200 may also have additional steam tubes and heat transfer fins. For example, FIG. 9 and FIG. 10 are different views of another embodiment of the transition casting 200. FIG. 9 is a perspective view and FIG. 10 is a front view. In FIG. 9 and FIG. 10 the transition casting 200 also has a second steam tube 230 and a second heat transfer fin 252. The second steam tube 230 also has a steam passageway extending between a front end 232 pointing in the forward direction and a vertical end 234 pointing in the first vertical direction 201. The second heat transfer fin 252 extends from the membrane 240 and abuts the first water tube 220. In FIG. 9 and FIG. 10, the second heat transfer fin 252 also abuts the second steam tube 230 and extends between the second steam tube 230 and the first water tube 220 and may be welded to these tubes 220, 230. As can be best seen in FIG. 10, the membrane 240 joins the first steam tube 210, the first water tube 220, and the second steam tube 230 together to form a pressure seal therebetween.

The transition casting 200 may also have additional water tubes. For example, FIGS. 11-13 are different views of another embodiment of the transition casting 200. FIG. 11 is a perspective view, FIG. 12 is a front view, and FIG. 13 is a side view. In FIGS. 11-13, the transition casting 200 also has a second water tube 260 in addition to the first water tube 220, the first steam tube 210, and the second steam tube 230. The second water tube 260 also has a water passageway extending between a first end 262 and a vertical end 264 pointing in the second vertical direction 203.

As seen particularly in FIG. 7 and FIG. 10, the first end 222 of the first water tube 220 can be a front end pointing in the forward direction (i.e., in the same direction as the front end 212 of the first steam tube 210). In particular embodiments, such as that shown in FIG. 7, the first end 222 of the first water tube 220 can be positioned in vertically aligned arrangement with the front end 212 of the first steam tube 210.

In contrast to FIG. 7, FIG. 10 shows an embodiment in which the first heat transfer fin 250 abuts the first water tube 220 and extends to the first steam tube 210 at an angle relative to the upper vertical direction 205. As such, the front end 212 of the first steam tube 210 is both laterally and vertically offset from the first end 222 of the first water tube 220. Similarly, as shown in this embodiment, the second heat transfer fin 252 abuts the first water tube 220 and extends to the second steam tube 230 at an angle relative to the upper vertical direction 205. As such, the front end 232 of the second steam tube 230 is also both laterally and vertically offset from the first end 222 of the first water tube 220. In this particular embodiment, the front end 212 of the first steam tube 210 is in at the same level as the front end 232 of the second steam tube 230.

In certain embodiments, such as that shown in FIG. 12, the front end 212 of the first steam tube 210 is in vertically aligned arrangement with the first end 222 of the first water tube 220 (as shown by the first heat transfer fin 250 extending between the first steam tube 210 and first water tube 220 in the vertical direction 201). In contrast, the front end 232 of the second steam tube 230 shown in this embodiment is vertically offset from the first end 222 of the first water tube 220 (as shown by the second heat transfer support 252 extending between the second steam tube 230 and first water tube 220 at an angle relative to the vertical direction 201).

Figure 14:
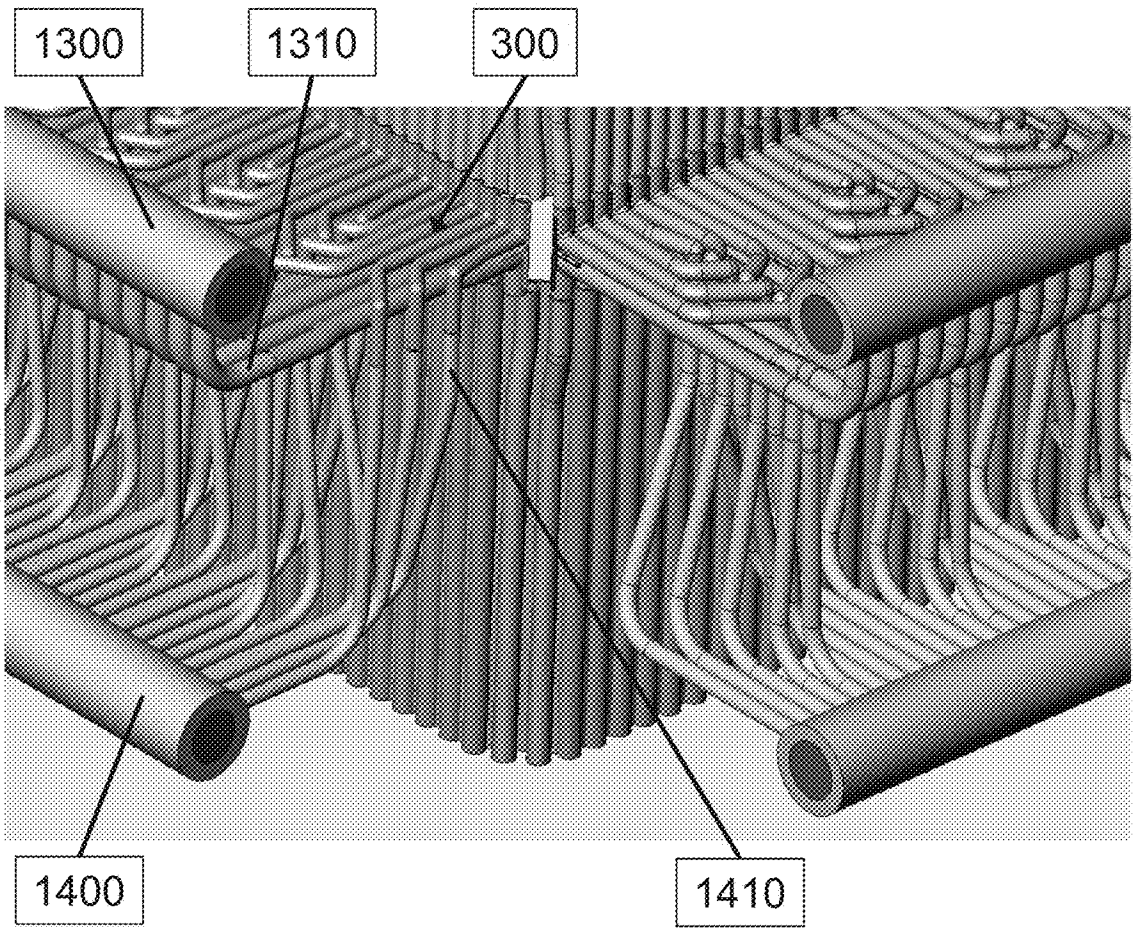
FIG. 14 is another magnified perspective view of the boiler of FIG. 1 showing the transition section with a second exemplary transition casting.

FIG. 14 is another magnified perspective view of the boiler showing a second, different transition section 16. In FIG. 14, the transition section includes a second exemplary transition casting 300. As will be explained in greater detail further herein, the transition casting includes steam tubes and water tubes. Dry/superheated steam flows through the steam tubes, and saturated steam (i.e. a water/steam mixture) flows through the water tubes. As seen here, a steam inlet header 1400 is present outside the pressure boundary (i.e. on the exterior of the furnace) and is located below the transition casting 300, permitting inlet header 1400 to be ventable. Steam-cooled tube 1410 connects the transition casting 300 and steam inlet header 1400. A water outlet header 1300 is also located outside of the pressure boundary and is located above the transition casting 300. Water-cooled tube 1310 connects the transition casting 300 to the water outlet header 1300.

Figure 15:
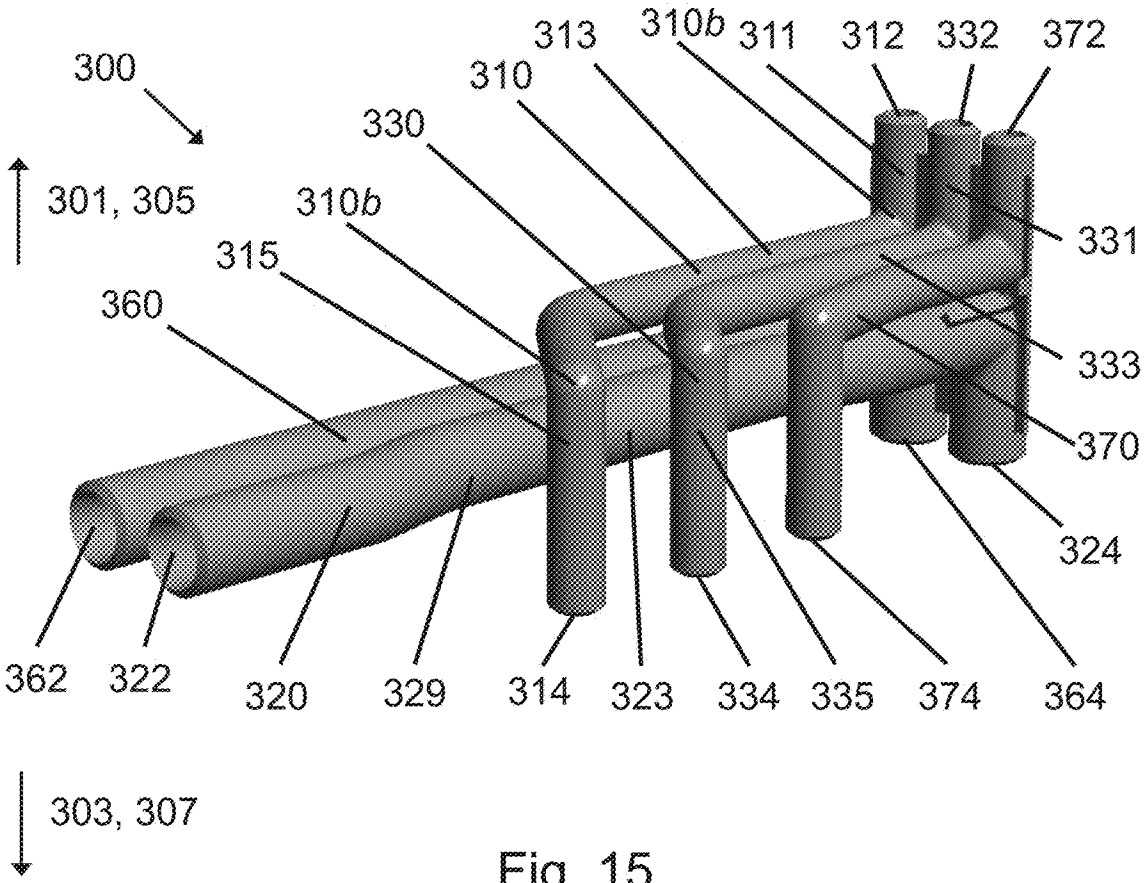
FIG. 15 is a perspective view of the second exemplary transition casting of FIG. 14.
Figure 16:
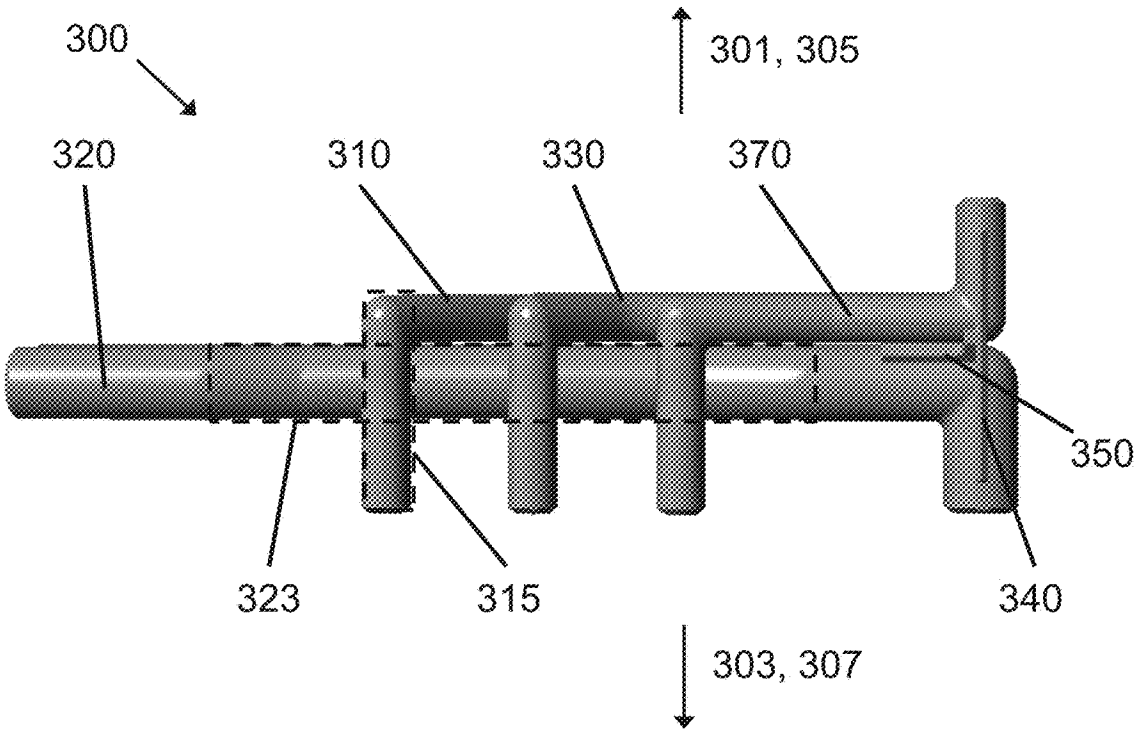
FIG. 16 is a side view of the second exemplary transition casting of FIG. 15.
Figure 17:
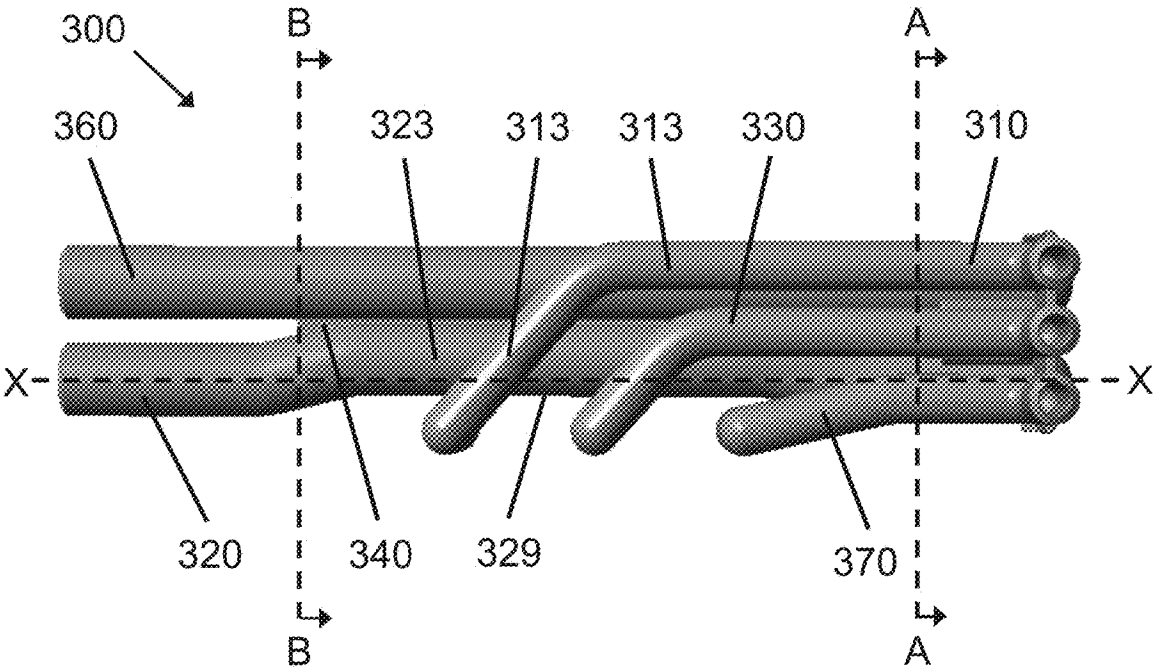
FIG. 17 is a top view of the second exemplary transition casting of FIG. 15.
Figure 18:
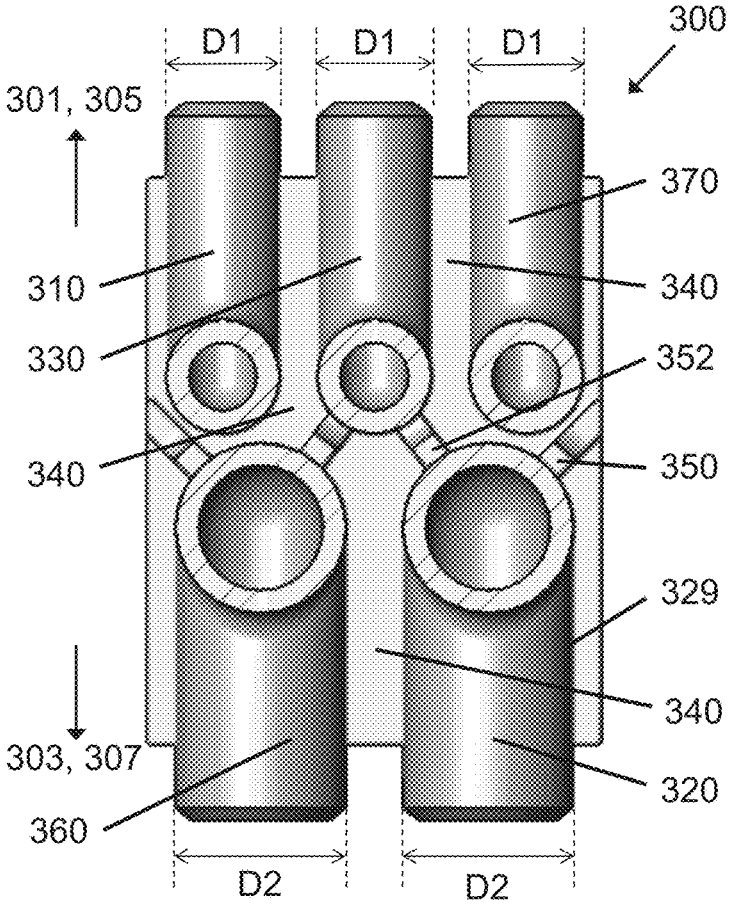
FIG. 18 is a cross-sectional view of the second exemplary transition casting of FIG. 17 taken along line A-A.
Figure 19:
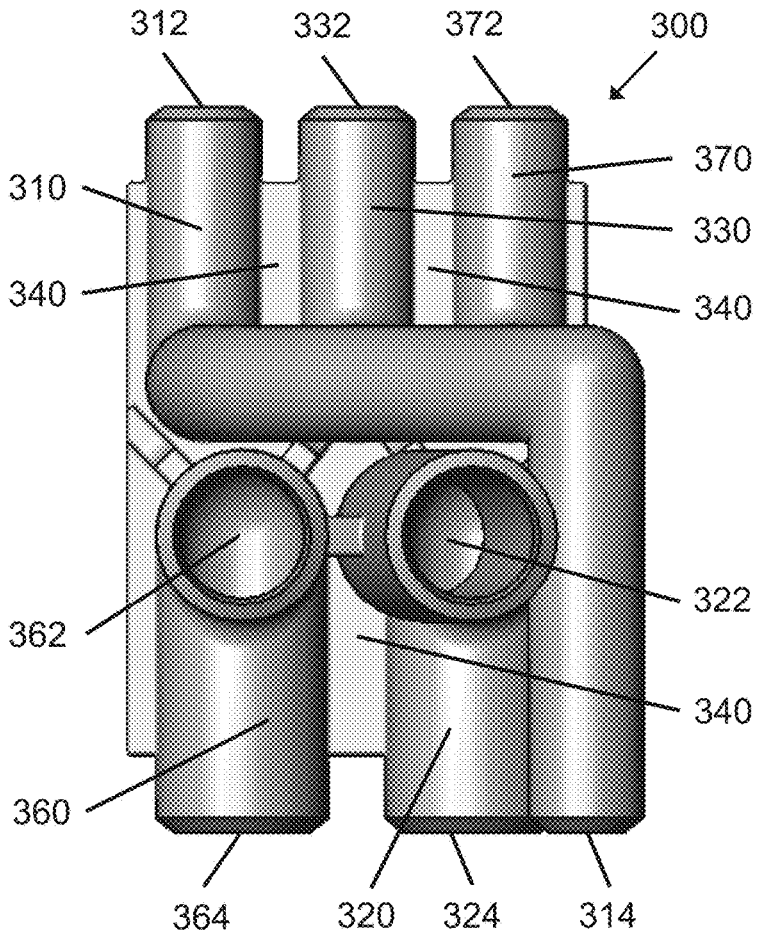
FIG. 19 is a cross-sectional view of the second exemplary transition casting of FIG. 17 taken along line B-B.

FIGS. 15-19 are different views of the second embodiment of a transition casting 300. FIG. 15 is a perspective view, FIG. 16 is a side view, and FIG. 17 is a top view. FIG. 18 is a cross-sectional view along line A-A of FIG. 17 and FIG. 19 is a cross-sectional view along line B-B of FIG. 17. The various components of the second exemplary transition casting will now be described below.

Referring now to FIGS. 15-19, the transition casting 300 is broadly defined by a first steam tube 310, a first water tube 320, and a membrane 340 that joins these tubes 310, 320 together to form a pressure seal. The first steam tube 310 has a steam passageway extending between an upper end 312 and a lower end 314. The upper end 312 points in a first vertical direction 301/an upper vertical direction 305. The lower end 314 points in a second vertical direction 303. The second vertical direction 303 is opposite that of the first vertical direction 301, and in this case is also a lower vertical direction 307. The steam passageway of the first steam tube 310 includes a first vertical section 311, an intermediate section 313, and a second vertical section 315. The first vertical section 311 of the first steam tube 310 extends between the upper end 312 and the intermediate section 313. The intermediate section 313 extends between the first vertical section 311 and the second vertical section 315. Viewing FIG. 15, it can be seen that the intermediate section 313 extends horizontally and terminates at bends 310*b* that separate the intermediate section 313 from the first and second vertical sections 311, 315. The second vertical section 315 extends between the intermediate section 313 and the lower end 314. In this way, the first vertical section 311 extends in the upper vertical direction 305 and the second vertical section 315 extends in the lower vertical direction 307. Put another way, the first and second vertical sections 311, 315 extend substantially parallel to one another.

The first water tube 320 has a water passageway extending between a first end 322 pointing in the forward direction (i.e. outwardly from the furnace) and a vertical end 324 pointing in the second vertical direction 303/a lower vertical direction 307. In certain embodiments, the first water tube 320 includes an intermediate section 323. As can be best seen in FIG. 17, the intermediate section 323 of the first water tube 320 is offset from an axis X-X passing through the centers of the front end 322 and the vertical end 324 of the first water tube 320. Put another way, the first water tube 320 is bent at its intermediate section 323. As such, the intermediate section 323 is offset from the front end 322 and the vertical end 324 of the first water tube 320, which are in line with one another.

In the embodiments of the transition casting 300 shown in FIGS. 15-19, the intermediate section 313 of the first steam tube 310 bends such that the upper end 312 of the first steam tube 310 is on one side of a first lateral side 329 of the first water tube 320 and the lower end 314 of the first steam tube 310 is on an opposite side of the first lateral side 329 of the first water tube 320. Put another way, FIG. 15 shows a first lateral side 329 of the first water tube 320, which is most easily seen in FIG. 17 and FIG. 18. The bend of the intermediate section 313 of the first steam tube 310 is such that the upper end 312 of the first steam tube 310 is on one side of the first lateral side 329 (i.e., above the first lateral side 329 in FIG. 17) and the lower end 314 of the first steam tube 310 is on an opposite side of the first lateral side 329 (i.e., below the first lateral side 329 in FIG. 15). In this way, the first vertical section 311 extends in the upper vertical direction 305 on one side of the first lateral side 329 of the first water tube 320, while the second vertical section 315 extends in the lower vertical direction 307 on an opposing side of the first lateral side 329 of the first water tube 320. Put another way, the first and second vertical sections 311, 315 extend substantially parallel to one another, but on opposing sides of the first lateral side 329 of the first water tube 320.

As shown in FIG. 15, the intermediate section 313 of the first steam tube 310 extends across the intermediate section 323 of the first water tube 320. In this way, the second vertical section 315 of the first steam tube 310 extends adjacent to the intermediate section 323 of the first water tube 320 in the lower vertical direction 307.

The first steam tube 310 has a steam tube diameter D1, as shown in FIG. 18. The first water tube 320 has a water tube diameter D2, as also shown in FIG. 18. In particular embodiments, the water tube diameter D2 is greater than the steam tube diameter D1.

It is to be understood and appreciated that the transition casting 300 may also have additional steam tubes. For example, FIGS. 15-19 show the transition casting 300 with a second steam tube 330. The second steam tube 330 also has a steam passageway extending between an upper end 332 pointing in the first vertical direction 301 and a lower end 334 pointing in the second vertical direction 303. The steam passageway of the second steam tube 330 includes a first vertical section 331, an intermediate section 333, and a second vertical section 335. The first vertical section 331 of the second steam tube 330 extends between the upper end 332 and the intermediate section 333, the intermediate section 333 extends between the first vertical section 331 and the second vertical section 335, and the second vertical section 335 extends between the intermediate section 333 and the lower end 334. As can be best seen in FIG. 15, the intermediate section 333 of the second steam tube 330 bends similarly to the intermediate section 313 of the first steam tube 310. More particularly, the intermediate section 333 of the second steam tube 330 bends such that the upper end 332 of the second steam tube 330 is on one side of the first lateral side 329 of the first water tube 320 and the lower end 334 of the second steam tube 330 is on the opposing side of the first lateral side 329 of the first water tube 320. In this way, the upper end 332 of the second steam tube 330 is on the same side of the first lateral side 329 of the first water tube 320 as the upper end 312 of the first steam tube 310, and the lower end 334 of the second steam tube 330 is on the same side of the first lateral side 329 of the first water tube 320 as the lower end 314 of the first steam tube 310. As shown in FIG. 15, the intermediate section 333 of the second steam tube 330 extends across the intermediate section 323 of the first water tube 320. In this way, the second vertical section 335 of the second steam tube 330 extends adjacent to the intermediate section 323 of the first water tube 320 in the lower vertical direction 307. As can also be seen from FIG. 15, the first vertical section 311 of the first steam tube 310 extends substantially parallel to the first vertical section 331 of the second steam tube 330 in the upper vertical direction 305. Similarly, the second vertical section 315 of the first steam tube 310 extends substantially parallel to the second vertical section 335 of the second steam tube 330 in the lower vertical direction 307. As seen in FIG. 16, a first edge of the fin 350 abuts the membrane 340, and a second edge of the fin 350 abuts the water tube. The first edge is generally short compared to the second edge. The fin may also be coped.

It is to be further understood and appreciated that the transition casting 300 may also have additional water tubes. For example, FIGS. 15-19 show the transition casting 300 with a second water tube 360. The second water tube 360 also has a water passageway extending between a first end 362 pointing in the forward direction and a vertical end 364 pointing in the second vertical direction 303.

In particular embodiments, the transition casting 300 includes a first heat transfer fin 350. The first heat transfer fin 350 can be best seen in FIG. 18 and FIG. 19. FIG. 18 is a cross-sectional view of the transition casting 300 of FIG. 17 taken along line A-A in FIG. 17, and FIG. 19 is a cross-sectional view of the transition casting 300 of FIG. 17 taken along line B-B in FIG. 17. The first heat transfer fin 350 extends from the membrane 340 and abuts the first water tube 320. In this way, the first heat transfer fin 350 facilitates heat transfer between the membrane 340 and the tubes to which it abuts.

With continued reference to FIG. 18, the transition casting 300 can include additional heat transfer fins. For example, FIG. 18 shows second heat transfer fin 352, which extends from the membrane 340 and abuts the first water tube 320.

In FIG. 18, the second heat transfer fin 352 also abuts the second steam tube 330. As shown here, the second heat transfer fin 352 extends between the second steam tube 330 and the first water tube 320 and may be welded to these tubes 320, 330.

The present disclosure has been described with reference to exemplary embodiments. Obviously, modifications and alterations will occur to others upon reading and understanding the preceding detailed description. It is intended that the present disclosure be construed as including all such modifications and alterations insofar as they come within the scope of the appended claims or the equivalents thereof.

We claim:

1. A transition casting, comprising:

a first steam tube having a steam tube diameter and a steam passageway extending between a first steam tube front end pointing in a forward direction and a first steam tube vertical end pointing in a first vertical direction;

a first water tube having a water tube diameter and a water passageway extending between a first water tube first end and a first water tube vertical end pointing in a second vertical direction opposite the first vertical direction, the water passageway having at least one bend between the first water tube first end and the first water tube vertical end;

a membrane joining the first steam tube and the first water tube to form a pressure seal therebetween; and a first heat transfer fin extending from the membrane and abutting the first water tube and abutting the first steam tube, and extending between the first steam tube and the first water tube.

2. The transition casting of claim 1, wherein the first water tube first end is a first water tube front end pointing in the forward direction.

3. The transition casting of claim 1, wherein the water passageway has at least two bends between the first water tube first end and the first water tube vertical end.

4. The transition casting of claim 3, wherein the at least two bends include a first bend and a second bend, the first bend having an angle of about 90° relative to a horizontal axis defined by the forward direction and the second bend having an angle of about 30° to 60° relative to the horizontal axis defined by the forward direction.

5. The transition casting of claim 4, wherein the first steam tube front end is vertically aligned with the first water tube first end.

6. The transition casting of claim 5 further, comprising:

a second steam tube having the steam tube diameter and a steam passageway extending between a second steam tube front end pointing in a forward direction and a second steam tube vertical end pointing in a first vertical direction; and a second heat transfer fin welded to and extending from the membrane and abutting the first water tube and abutting the second steam tube;

wherein the membrane joins the first and second steam tubes and the first water tube to form a pressure seal therebetween.

7. The transition casting of claim 6, wherein the first steam tube vertical end and the second steam tube vertical end are both laterally offset from the first water tube.

8. The transition casting of claim 7, wherein the first steam tube front end and the second steam tube front end are both vertically and laterally offset from the first water tube first end.

9. The transition casting of claim 6, wherein the first steam tube front end is vertically aligned with the first water tube first end tube and the second steam tube front end is vertically offset from the first water tube first end.

10. The transition casting of claim 9, wherein the water tube diameter is greater than the steam tube diameter.

11. A boiler, comprising:

an upper furnace having steam-cooled membrane walls comprising steam wall tubes;

a lower furnace having water-cooled membrane walls comprising water wall tubes; and a transition casting disposed between the upper furnace and the lower furnace, the transition casting comprising:

a first steam tube having a steam tube diameter and a steam passageway extending between a first steam tube front end pointing in a forward direction and a first steam tube vertical end pointing in a first vertical direction;

a first water tube having a water tube diameter and a water passageway extending between a first water tube first end and a first water tube vertical end pointing in a second vertical direction opposite the first vertical direction, the water passageway having at least one bend between the first water tube first end and the first water tube vertical end;

a membrane joining the first steam tube and the first water tube to form a pressure seal therebetween; and a first heat transfer fin extending from the membrane and abutting the first water tube and abutting the first steam tube, and extending between the first steam tube and the first water tube.

12. The boiler of claim 11, wherein the first steam tube is fluidly connected to a steam inlet header, and the first water tube is fluidly connected to a water outlet header located below the transition casting.

13. The boiler of claim 12, wherein the lower furnace is top-supported through the transition casting.

14. The boiler of claim 13, wherein the water tube diameter is greater than the steam tube diameter.

15. The transition casting of claim 1, wherein the transition casting is a single-piece transition casting.

* * * * *